US007575301B2

(12) United States Patent
Yamanobe et al.

(10) Patent No.: US 7,575,301 B2
(45) Date of Patent: Aug. 18, 2009

(54) IMAGE FORMING APPARATUS AND IMAGE FORMING METHOD

(75) Inventors: Jun Yamanobe, Kanagawa (JP); Tetsuzo Kadomatsu, Kanagawa (JP); Masaaki Konno, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 384 days.

(21) Appl. No.: 11/190,948

(22) Filed: Jul. 28, 2005

(65) Prior Publication Data

US 2006/0023015 A1 Feb. 2, 2006

(30) Foreign Application Priority Data

Jul. 30, 2004 (JP) ..... 2004-223843
Aug. 30, 2004 (JP) ..... 2004-250422

(51) Int. Cl.
*B41J 2/06* (2006.01)
*B41J 29/38* (2006.01)

(52) U.S. Cl. ..... 347/55; 347/6; 347/9

(58) Field of Classification Search ..... 347/16, 347/9, 6, 55

See application file for complete search history.

(56) References Cited

U.S. PATENT DOCUMENTS 5,270,729 A * 12/1993 Stearns ..... 347/128
5,821,968 A * 10/1998 Ohyama et al. ..... 347/104
6,309,064 B1 * 10/2001 Tanno et al. ..... 347/104
6,508,540 B1 * 1/2003 Lean et al. ..... 347/55

FOREIGN PATENT DOCUMENTS

JP 02-212149 A 8/1990
JP 05-4342 A 1/1993
JP 05-4343 A 1/1993

* cited by examiner

*Primary Examiner*—Julian D Huffman
*Assistant Examiner*—Jason S Uhlenhake
(74) *Attorney, Agent, or Firm*—Birch, Stewart, Kolasch & Birch, LLP

(57) ABSTRACT

The image forming apparatus comprises: an ejection head which ejects droplets having electro rheological effects onto a recording medium; a holding device which holds the recording medium, the holding device being disposed at a position facing an ejection side surface of the ejection head, the recording medium interposing between the ejection head and the holding device; a pair of electrodes which is disposed on the holding device, the pair of electrodes comprising a first electrode and a second electrode; and a voltage application device which applies a voltage to the pair of electrodes.

24 Claims, 18 Drawing Sheets

IMAGE FORMING APPARATUS AND IMAGE FORMING METHOD

BACKGROUND OF THE INVENTION

1. Field of the Invention

The present invention relates to an image forming apparatus and an image forming method, and more particularly to an image forming apparatus and an image forming method that droplets are ejected from nozzles to form images on a recording medium.

2. Description of the Related Art

Image forming apparatuses with inkjet systems form images on a recording medium by ejecting ink from nozzles provided to a print head. In such image forming apparatuses, when second ink droplets are deposited so as to overlap first ink droplets that are deposited first on the recording medium, if the first ink droplets remain unsettled on the recording medium, the ink droplets mix together in the areas where the second ink droplets and the unsettled first ink droplets overlap, which blurs the original shape of the dots, creates mixed colors when inks of different colors are used, and causes degradation in the image. The mixing together of ink droplets deposited on the recording medium is referred to as a "deposition interference" or a "landing interference."

In view of this, in order to prevent deposition interference or the smearing or mixing of ink on the recording medium, a technique has been proposed that uses an electro rheological fluid (see Japanese Patent Application Publication Nos. 2-212149, 5-4342, and 5-4343).

Japanese Patent Application Publication No. 2-212149 discloses a technique for applying an electric field to the recording medium on which the recording liquid is deposited after the recording liquid that has electro rheological effects is deposited on the recording medium, so as to suppress permeation of the recorded dots and to prevent smearing or decreases in concentration.

Japanese Patent Application Publication No. 5-4342 discloses a technique that droplets of a recording liquid having electro rheological effects, which are formed by a recording head (print head), are deposited onto an intermediate transfer medium with an electric field formed on the surface, so as to increase the viscosity of the droplets on an intermediate transfer medium. Since the droplets in a thickened state are transferred onto a transfer medium (recording medium), it is possible to prevent the recorded dots from expanding excessively or from mixing. Also, in Japanese Patent Application Publication No. 5-4342, it is described that the strength of the electric field applied to the recording liquid in the recording head should be adjusted to zero or the viscosity of the recording liquid when the electric field is applied should be adjusted to no more than a specific value, in order to perform droplet ejection with the recording head in a stable condition.

Japanese Patent Application Publication No. 5-4343 discloses a technique that droplets of a recording liquid having electro rheological effects, which are formed by a recording head, are deposited onto a transfer medium with an electric field formed on the surface, so as to increase instantaneously the viscosity or yield value of the recording liquid. Therefore, it is possible to prevent smearing, deterioration, and color mixing in the recording dots. Also, Japanese Patent Application Publication No. 5-4343 describes that the strength of the electric field applied to the recording liquid in the recording head should be adjusted in the same manner as in Japanese Patent Application Publication No. 5-4342.

Furthermore, in those references, a method is described in which a corotron device and other electric charging devices are used as an electric field formation device to provide an electric charge to the surface of transfer medium or intermediate transfer medium depositing the recording liquid so that an electric field is formed on the surface thereof. In addition, another method is also described in which a pair of electrodes is provided on both sides of the transfer medium so that a direct current voltage is applied to the pair of electrodes to form an electric field.

However, it has been made clear though the experiments of the inventors that the viscosity of the liquid deposited on the recording medium does not increase sufficiently even if an electric field is formed by the electric field formation devices disclosed in Japanese Patent Application Publication Nos. 2-212149, 5-4342, and 5-4343, which results in deposition interference between droplets on the recording medium, and in permeation smearing or color smearing in which the deposited droplets permeate and smear on the recording medium.

Additionally, the viscosity of the recording liquid with which unsatisfactory ejection occurs in the recording head is far less than the viscosity at which deposition interference and the like between droplets on the recording medium can be prevented, and is about 1/100th to 1/1000th of the viscosity needed for the droplets on the recording medium to avoid deposition interference. Therefore, when applying an electric field to the droplets deposited on the recording medium, the image forming apparatus might be designed with regard to the thickness of the recording liquid in the recording head. However, although the necessity of adjusting the strength of the electric field applied to the recording liquid in the recording head is described in Japanese Patent Application Publication Nos. 5-4342 and 5-4343, the specific device for this purpose is not indicated specifically.

SUMMARY OF THE INVENTION

The present invention has been designed in consideration of these circumstances, and a first object thereof is to prevent deposition interference, permeation smearing, color smearing, and the like by creating an electric field that can sufficiently exhibit electro rheological effects when ink with electro rheological effects is used; and a second object thereof is to prevent unsatisfactory ejections resulting from the thickening of the ink near the nozzles.

In order to attain the aforementioned objects, the present invention is directed to an image forming apparatus comprising: an ejection head which ejects droplets having electro rheological effects onto a recording medium; a holding device which holds the recording medium, the holding device being disposed at a position facing an ejection side surface of the ejection head, the recording medium interposing between the ejection head and the holding device; a pair of electrodes which is disposed on the holding device, the pair of electrodes comprising a first electrode and a second electrode; and a voltage application device which applies a voltage to the pair of electrodes.

According to the present invention, when voltage is applied to the electrodes disposed on the reverse side of the droplets-deposited surface of the recording medium, an electric field having a substantially arcuate lines of electric force between the pair of electrodes is applied to the droplets deposited on the recording medium, and an electric current sufficient to obtain the specific electro rheological effects flows through the droplets. Those operations are suitable for increasing the viscosity of droplets having electro rheological effects, and it is possible to prevent deposition interference, permeation smearing, color smearing, and the like, reliably.

The "pair of electrodes comprising a first electrode and a second electrode" creates an electric field with a specific electric field strength in the periphery of the pair of electrodes when a relative electric potential difference is applied to the first electrode and the second electrode (i.e., when voltage is applied to the electrodes). Therefore, the pair of electrodes comprising the first electrode and the second electrode includes positive and negative electrodes so that one electrode has a positive electric potential and another electrode has a negative electric potential, and also includes a pair of electrodes that are both positive and negative.

The "recording medium" (also referred to as a print medium, an image forming medium, a recorded medium, an image receiving medium, and the like) is a medium on which images are recorded by the operation of the ejection head, and it includes various mediums regardless of material or shape, such as continuous paper, cut paper, sealing paper, OHP sheets and other such resin sheets, films, cloth, and print substrates on which a wiring pattern or the like is formed by an inkjet head.

The present invention is also directed to the image forming apparatus further comprising a low-conductivity layer which is provided in a recording medium side of the pair of electrodes.

According to the present invention, the low-conductivity layer protects the pair of electrodes, and prevents the pair of electrodes from being electrically charged when the printing operation is not being performed, such as when the power source is turned off.

The present invention is also directed to the image forming apparatus wherein: each of the first electrode and the second electrode forms in a comb shape, comprising a plurality of substantially comb tooth portions in each plane of the first electrode and the second electrode; and the comb tooth portions of the first electrode and the comb tooth portions of the second electrode are arranged alternately.

According to the present invention, since each the comb tooth portions in first and second electrodes formed in a comb shape are arranged alternately, it is possible to apply a strong electric field uniformly to the entire print unit on the recording medium.

The present invention is also directed to the image forming apparatus wherein: the holding device is formed with a greater width than the recording medium; and the holding device is formed so that a length of the comb tooth portions of the first electrode and the second electrode is greater than a width of the recording medium.

According to the present invention, an electric field having substantially arcuate lines of electric force between the pair of electrodes is applied to the droplets deposited over the entire surface of the recording medium, and electric current flows through the droplets. Therefore, it is possible to prevent deposition interference, permeation smearing, color smearing, and other such problems, more reliably.

The present invention is also directed to the image forming apparatus wherein the holding device conveys the recording medium.

According to the present invention, since the holding device on which the pair of electrodes is disposed may be made to further function as a conveyance device for the recording medium, such as an endless belt, a roller, a moving table, or the like, it is possible to reduce the size of the image forming apparatus.

The present invention is also directed to the image forming apparatus further comprising a drive device which drive the holding device, wherein: the holding device is an endless belt driven by the drive device; the voltage application device applies the voltage to the drive device; the first electrode and the second electrode are disposed so that a back part of the comb shape of the first electrode and a back part of the comb shape of the second electrode are positioned respectively at side ends of the endless belt, the back part being a common electrode portion which connects the respective comb tooth portions; and the common electrode portion comes into contact with the drive device so as to conduct electrically.

According to the present invention, since the common electrode portion can obtain electrical conductivity by a simple method, it is possible to simplify the configuration of the image forming apparatus.

In order to attain the aforementioned object, the present invention is directed to an image forming apparatus comprising: an ejection head which ejects droplets having electro rheological effects onto a recording medium; a holding device which holds the recording medium, the holding device being disposed at a position facing an ejection side surface of the ejection head, the recording medium interposing between the ejection head and the holding device; a pair of electrodes which is disposed on the holding device, the pair of electrodes comprising a first electrode and a second electrode; and a voltage application device which applies a voltage to the pair of electrodes, wherein: when a specific voltage is applied to the pair of electrodes by the voltage application device, an electric field strength on the recording medium takes a value at which the droplets deposited on the recording medium do not cause interference with each other or a value at which a permeation speed of the deposited droplets into the recording medium is a specific value or less while an electric field strength in the ejection side surface of the ejection head is not large enough to affect a droplet ejection of the ejection head.

According to the present invention, when a specific voltage is applied to the pair of electrodes, an electric field with a substantially arcuate line of electric force to connect the pair of electrodes is applied to the droplets deposited on the recording medium. At this time, the configuration is designed so that the electric field strength on the recording medium and the electric field strength in the ejection side surface of the ejection head are within a specific range. Therefore, it is possible to prevent unsatisfactory ejection in the ejection side surface of the ejection head. In addition, it is also possible to prevent deposition interference, permeation smearing, color smearing, and the like in the droplets deposited on the recording medium.

Furthermore, since the pair of electrodes is disposed on the reverse side of the droplets-deposited surface of the recording medium when a voltage is applied to the pair of electrodes, an electric field is applied to the droplets on the recording medium, and then very weak electric current flows through the droplets. Such an operation is suitable for increasing the viscosity of droplets that have electro rheological effects, and can reliably prevent deposition interference, permeation smearing, color smearing, and the like.

The term "specific value of the permeation speed" is a value which is maintained until the droplets deposited on the recording medium reach a state of permeating and smearing on the recording medium while they are settling.

The term "not large enough to affect droplet ejection" is to prevention of ink ejection failure, misalignment of the ejection position, ejection amount irregularities, ejection time lag, and other such unsatisfactory ejections.

The present invention is also directed to the image forming apparatus wherein: the first electrode and the second electrode are disposed at a specific distance; and the specific distance is set to a distance at which the electric field strength on the recording medium takes the value at which the droplets deposited on the recording medium do not cause interference with each other or the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

According to the present invention, since the first electrode and second electrode disposed at a specific distance, it is possible to prevent unsatisfactory ejection in the ejection surface of the ejection head. In addition, it is also possible to prevent deposition interference, permeation smearing, color smearing, and the like in the droplets deposited on the recording medium.

The present invention is also directed to the image forming apparatus wherein: each of the first electrode and the second electrode forms a comb shape, comprising a plurality of substantially comb tooth portions in each plane of the first electrode and the second electrode; and the comb tooth portions of the first electrode and the comb tooth portions of the second electrode are arranged alternately; the comb tooth portions of the first electrode and the comb tooth portions of the second electrode are disposed at a specific distance; and the specific distance is set to a distance at which the electric field strength on the recording medium takes the value at which the droplets deposited on the recording medium do not cause interference with each other or the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

According to the present invention, when a specific voltage is applied to the pair of electrodes, an electric field with a substantially arcuate line of electric force to connect the comb tooth portions in the positive and negative electrodes is applied to the droplets deposited on the recording medium. Since the comb tooth portions of the positive electrode and the comb tooth portions of the negative electrode are disposed at a specific distance, it is possible to prevent unsatisfactory ejection in the ejection surface of the ejection head. In addition, it is also possible to prevent deposition interference, permeation smearing, color smearing, and the like in the droplets deposited on the recording medium.

The present invention is also directed to the image forming apparatus wherein: each of the first electrode and the second electrode has a plurality of electrode pieces; the electrode pieces of the first electrode and the electrode pieces of the second electrode are arranged alternately in a matrix configuration; the electrode pieces of the first electrode and the electrode pieces of the second electrode are disposed at a specific distance; and the specific distance is set to a distance at which the electric field strength on the recording medium takes the value at which the droplets deposited on the recording medium do not cause interference with each other or the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

According to the present invention, when a specific voltage is applied to the pair of electrodes, an electric field with a substantially arcuate line of electric force to connect the electrode pieces in the positive and negative electrodes is applied to the droplets deposited on the recording medium. Since the electrode piece of the positive electrode and the electrode of the negative electrode are disposed at a specific distance, it is possible to prevent unsatisfactory ejection in the ejection surface of the ejection head. In addition, it is also possible to prevent deposition interference, permeation smearing, color smearing, and the like in the droplets deposited on the recording medium. Incidentally, embodiments according to the present invention are not particularly limited to the planar shape of the electrode pieces, which may be a substantial square, a substantial rectangle, a substantial circle, a substantial ellipse, or another such arbitrary shape, for example.

Furthermore, the present invention also provides a method for attaining the aforementioned objects. More specifically, the present invention is directed to an image forming method for an image forming apparatus, comprising the steps of: holding a recording medium by a holding device which is disposed at a position facing an ejection side surface of an ejection head, the recording medium interposing between the ejection head and the holding device; applying a voltage from a voltage application device to a pair of electrodes which is disposed on the holding device, the pair of electrodes comprising a first electrode and a second electrode; ejecting droplets having electro rheological effects onto the recording medium from the ejection head; and setting a distance between the first electrode and the second electrode at a specific distance, wherein: the specific distance is a distance at which an electric field strength on the recording medium takes a value at which the droplets deposited on the recording medium do not cause interference with each other or a value at which a permeation speed of the deposited droplets into the recording medium is a specific value or less while an electric field strength in the ejection side surface of the ejection head is not large enough to affect a droplet ejection of the ejection head, when a specific voltage is applied to the pair of electrodes by the voltage application device.

As described above, according to the present invention, when a voltage is applied to the pair of electrodes disposed on the reverse side of the droplets-deposited surface of the recording medium, an electric field with a substantially arcuate line of electric force to connect the pair of electrodes is applied to the droplets deposited on the recording medium, and an electric current sufficient to obtain specific electro rheological effects flows through the droplets. Those operations are suitable for increasing the viscosity of the droplets that have electro rheological effects, and can reliably prevent deposition interference, permeation smearing, color smearing, and the like.

In addition, when voltage is applied to the pair of electrodes, an electric field having a substantially arcuate line of electric force to connect the electrodes is applied to the droplets deposited on the recording medium. At this time, since the configuration is designed so that the electric field strength on the recording medium and the electric field strength in the ejection side surface of the ejection head reach a specific range, it is possible to prevented unsatisfactory ejection in the ejection side surface of the ejection head. Furthermore, it is also possible to prevent deposition interference, permeation smearing, color smearing, and the like in the droplets deposited on the recording medium.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment; Overall Configuration of Inkjet Recording Apparatus

Figure 1:
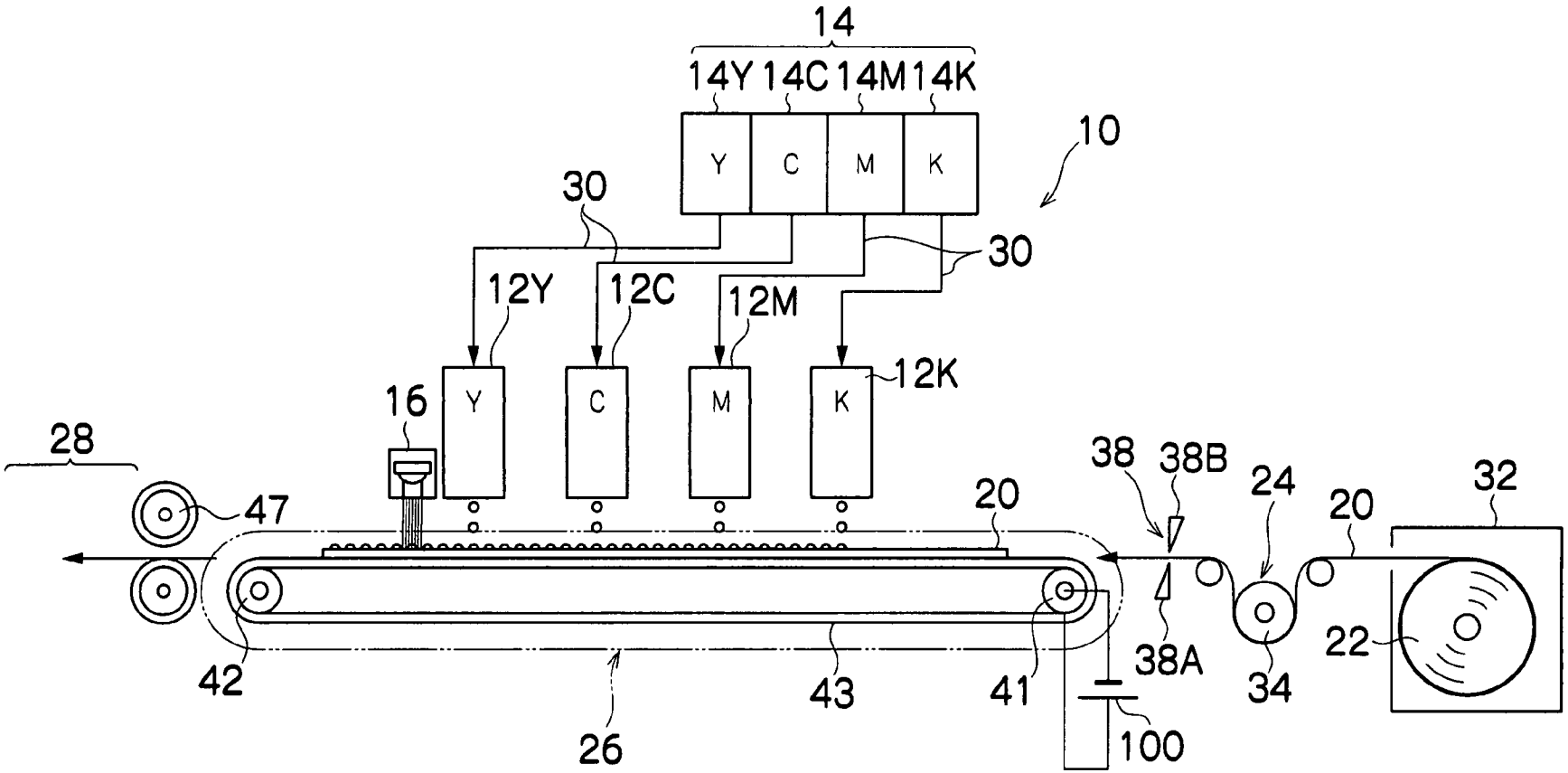
FIG. 1 is a general schematic drawing of an inkjet recording apparatus as an image forming apparatus according to a first embodiment of the present invention.

FIG. 1 is a general schematic drawing of an inkjet recording apparatus 10 according to a first embodiment of the present invention. As shown in FIG. 1, the inkjet recording apparatus 10 comprises a plurality of print heads 12K, 12M, 12C, and 12Y provided for each color of ink; an ink storing and loading unit 14 that stores the ink (in the present embodiment, UV-curing ink that has electro Theological effects) to be supplied to the print heads 12K, 12M, 12C, and 12Y; an ultraviolet source (UV source) 16 disposed on the downstream side in the conveyance direction of the print head 12Y (to the left hand in FIG. 1); a medium supply unit 22 that supplies a medium (recording medium) 20; a decurling process unit 24 that removes the curls in the medium 20; a conveying unit 26 that is disposed facing the nozzle surfaces (ink ejection surfaces) of the print heads 12K, 12M, 12C, and 12Y and also facing the light emission surface of the UV source 16, and that conveys the medium 20 while maintaining the planarity of the medium 20; and a paper output unit 28 that outputs the recording paper after recording (the prints) to the exterior.

The ink storing and loading unit 14 has ink tanks 14K, 14M, 14C, and 14Y that store the colored ink corresponding to the print heads 12K, 12M, 12C, and 12Y, and the tanks are communicated with the print heads 12K, 12M, 12C, and 12Y via a required duct line 30. Also, the ink storing and loading unit 14 comprises alerting devices (display device, warning sound producing device) that alert to the effect that the remaining amount of ink is low, and has a mechanism for preventing mistaken loading of colors.

An electro rheological fluid that has electro rheological effects in the UV-curing ink is used as the drawing ink in the present embodiment. The electro rheological fluid is a fluid that appears to instantaneously increase in viscosity by applying an electric field (voltage application), and the viscosity of the electro rheological fluid can be reversibly varied by turning the electric field on and off. There are two types of electro rheological fluid, such as a dispersive type and a homogenous type.

The dispersive type includes dielectric particles which are dispersed in fluid in an electrically insulated solvent. When the electric field is not applied, the dielectric particles remain dispersed with a low viscosity. However, when the electric field is applied, the polarized dielectric particles are formed in a chain structure (links) connected in the direction of the electric field. Since the formed links function to increase the viscosity of the fluid, the fluid behaves increasing of the viscosity. There are hydrous and anhydrous dispersive electro rheological fluids in the dispersive type.

On the other hand, the homogenous type exhibits anisotropy by orienting the particles and domains to the direction of the electric field, such as a liquid crystal and the like. Since the viscosity of the electro rheological fluids in actual practice uniform fluctuates a little under present circumstances, it is considered that dispersive electro theological fluids may come to be used in inkjet printers.

The present embodiment makes the UV-curing ink to have electro rheological effects. As the method for manufacturing such the ink, a various of methods are considered as following: a method of dispersing solid dielectric particle (silica gel, starch, dextrin, carbon, gypsum, gelatin, alumina, cellulose, mica, zeolite, and the like) in a fluid containing at least a radiation-curing monomer and a polymerization initiator; a method of using pigment particles themselves as a dispersant with electro rheological effects; a method of forming microcapsules out of dyes or pigments and using them as a dispersant with electro rheological effects by subjecting the surface to an insulation treatment; and a method of mixing homogenous electro rheological fluids.

In FIG. 1, a magazine 32 of rolled paper (continuous paper) is shown as an example of the medium supply unit 22, but a plurality of magazines with different paper widths or paper quality may also be used. Paper may also be supplied in a cassette in which cut paper is stacked and loaded instead of or in addition to the rolled paper.

With a configuration capable of using a plurality of different media, it is preferable to control ink ejection so that the type of medium used is automatically determined and ink ejection appropriate to the type of medium is implemented by affixing a barcode or wireless tag or another such information recording member that records the medium type information, and reading the information from the information recording member with a reading device.

The medium 20 delivered from the medium supply unit 22 retains a tendency to roll and curl due to being loaded in the magazine 32. In order to eliminate this curling, heat is applied to the medium 20 with a heating drum 34 in the rolling direction of the magazine 32 and the opposite direction in the decurling process unit 24. At this time, it is more preferable to control the heating temperature so that some of the printed surface curls slightly at the outer edges.

With an apparatus configuration that uses roll paper, a cutter 38 is provided for cutting, and the rolled paper is cut to a desired size by the cutter 38, as shown in FIG. 1. The cutter 38 is configured from a fixed blade 38A that has a length at least the width of the conveyance path of the medium 20 and a round blade 38B that moved along the fixed blade 38A, wherein the fixed blade 38A is provided to the printed reverse surface side, and the round blade 38B is disposed on the printed surface on the other side of the conveyance path. If cut paper is used, the cutter 38 is unnecessary.

After the decurling process, the cut medium 20 is sent to the conveying unit 26. The conveying unit 26 has a structure in which an endless belt-shaped electrode unit (electrostatic suction belt) 43 is rolled between the rollers 41 and 42, and is configured so that at least the portion facing the nozzle surfaces of the print heads 12K, 12M, 12C, and 12Y is a horizontal surface (flat surface).

When a high DC voltage is applied to the roller 41 by a high-voltage DC generator 100, the belt-shaped electrode unit 43 wound around the roller 41 is electrically charged, and the medium 20 is suctioned and held on the belt-shaped electrode unit 43 as a result of the electrostatic suctioning effects.

The motive force of a motor (not shown in FIG. 1, shown as the numeral 134 in FIG. 7) is transmitted to at least one of the rollers 41 and 42 around which the belt-shaped electrode unit 43 is wound, whereby the belt-shaped electrode unit 43 is driven to a counterclockwise direction in FIG. 1, and the medium 20 held on the belt-shaped electrode unit 43 is conveyed from the right hand to the left hand in FIG. 1.

The print heads 12K, 12M, 12C, and 12Y have a length corresponding to the maximum paper width of the medium 20 used with the inkjet recording apparatus 10, and constitute a full-line head in which a plurality of nozzles for ejecting ink are arrayed on the nozzle surfaces over a length exceeding at least one side of the medium 20 at maximum size (namely, the full width of the printable range).

The print heads 12K, 12M, 12C, and 12Y are disposed along the delivery direction of the medium 20 in order from the upstream side, and are fixed and set in place so that the print heads 12K, 12M, 12C, and 12Y extend along a direction substantially orthogonal to the conveyance direction of the medium 20.

A color image can be formed on the medium 20 by ejecting ink of each color from the print heads 12K, 12M, 12C, and 12Y while conveying the medium 20 with the conveying unit 26.

Thus, according to the configuration wherein the full-line type print heads 12K, 12M, 12C, and 12Y having a nozzle arrangement covering the entire paper width are provided for each color, it is possible to record images on the entire surface of the medium 20 merely by performing one operation (namely, with a single sub-scan) of moving the medium 20 relative to the print heads 12K, 12M, 12C, and 12Y toward the conveyance direction of the medium 20 (sub-scanning direction). In an image forming apparatus with such a single pass system, higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The UV source 16 disposed downstream of the print head 12Y has a length corresponding to the maximum paper width of the medium 20, similar to the print heads 12K, 12M, 12C, and 12Y, and is fixed in place so as to extend in a direction substantially orthogonal to the conveyance direction of the medium 20. For example, the UV source 16 is composed of a configuration in which ultraviolet LED elements or ultraviolet LD elements are arrayed in a line. Since light emission can be selectively controlled for each separate light emitting element by this configuration, it is possible to easily adjust the light emitting element to be illuminated or the amount of light emitted. Therefore, it is possible to achieve the desired irradiation range and light amount (strength) distribution in the area irradiated by ultraviolet rays.

The UV source 16 emits ultraviolet rays to promote curing of the ink droplets deposited by the print heads 12K, 12M, 12C, and 12Y which are disposed in upstream of the UV source 16. The ink droplets exposed to ultraviolet rays by the UV source 16 are preferably cured and settled to an extent at which image deterioration does not occur due to handling in the subsequent steps. Herein, the term "handling" refers to (1) rubbing between the roller or conveying guide and the image surface in the conveying step downstream of the UV source 16; (2) rubbing between prints in the print collecting part; and (3) rubbing with various substances when the finished prints are actually handled.

Then, the medium 20 that has passed through the UV source 16 (the produced print) is expelled from the paper output unit 28 via a nip roller 47. Though not shown in FIG. 1, the paper output unit 28 is provided with a sorter that stacks the images in accordance with the received orders.

Print Head Structure

Next, the structure of the print head will be described. The print heads 12K, 12M, 12C, 12Y provided for the respective ink colors have a common structure, and hence in the following description, a print head having the reference numeral 50 will be used as a representative thereof.

Figure 2A:
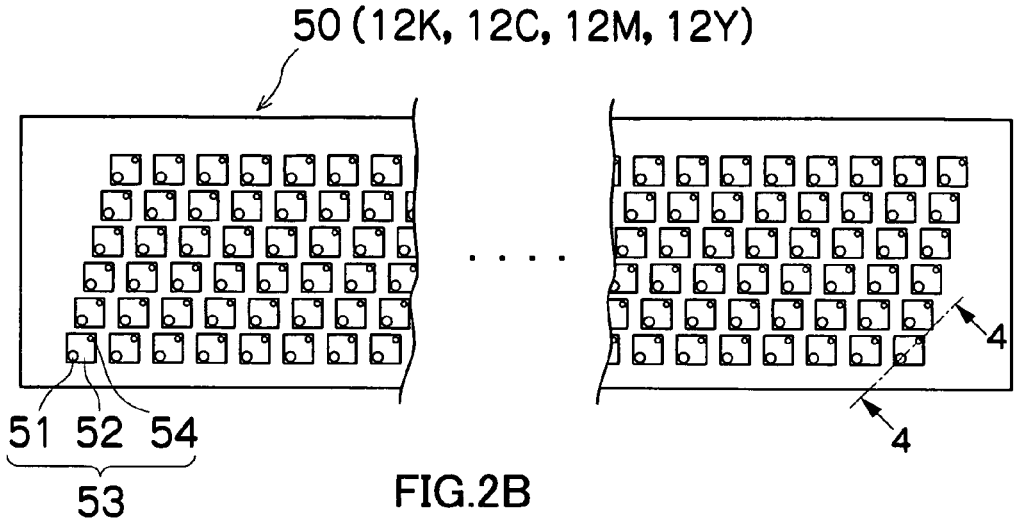
FIG. 2A is a perspective plan view showing a structural example of a print head.
Figure 2B:
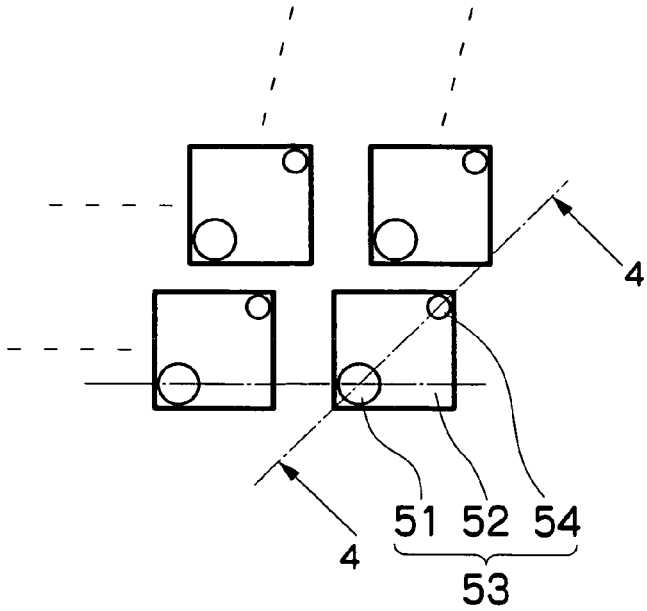
FIG. 2B is an enlarged view of a portion thereof.

FIG. 2A is a perspective plan view showing a structural example of the print head 50, and FIG. 2B is an enlarged view of one part thereof. Also, FIG. 3 is a perspective plan view showing another structural example of the print head 50, and FIG. 4 is a cross-sectional view (along the line 4-4 in FIGS. 2A and 2B) showing the independent configuration of one droplet ejection element (an ink chamber unit corresponding to one nozzle 51).

The nozzle pitch in the print head 50 should be minimized in order to maximize the density of the dots printed on the surface of the recording paper. As shown in FIGS. 2A to 4, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction perpendicular to the conveyance direction of the medium 20) is reduced and high nozzle density is achieved.

Figure 3:
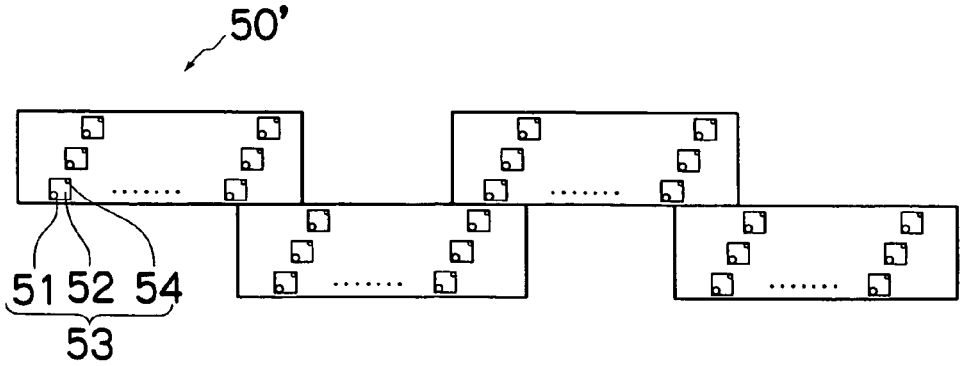
FIG. 3 is a perspective plan view showing another structural example of a print head.
Figure 4:
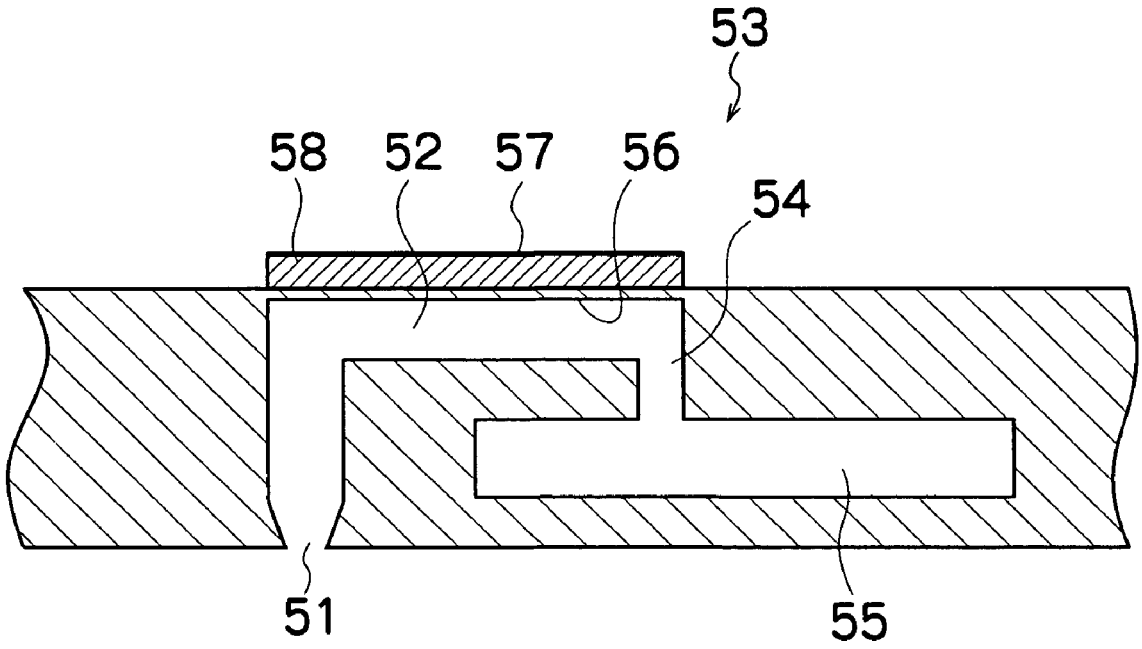
FIG. 4 is a cross-sectional view along the line 4-4 in FIGS. 2A and 2B.

Instead of the constitution shown in FIGS. 2A and 2B, short print head 50', in which the plurality of nozzles 51 are arranged two-dimensionally, may be arranged in staggered form and connected to form a full line head having nozzle arrays with a length corresponding to the entire width of the medium 20, as shown in FIG. 3.

As shown in FIGS. 2A and 2B, the planar shape of the pressure chamber 52 provided for each nozzle 51 is substantially a square, and the nozzle 51 and an inlet of supplied ink (supply port) 54 are disposed in both corners on a diagonal line of the square.

As shown in FIG. 4, the pressure chamber 52 is connected to a common channel 55 through the supply port 54. The common channel 55 is connected to an ink tank 60 (not shown in FIG. 4, but shown as a numeral 60 in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is joined to a pressure plate (common electrode) 56 constituting the ceiling face of the pressure chamber 52. By applying a drive voltage to the individual electrode 57 and the common electrode 56, the actuator 58 deforms, thereby altering the volume of the pressure chamber 52. This volume alteration leads to a variation in pressure which causes ink to be ejected from the nozzles 51. A piezoelectric body such as a piezo element is preferably used as the actuator 58. After the ink has been ejected, new ink is supplied to the pressure chamber 52 from a common flow passage 55 via a supply port 54.

Figure 5:
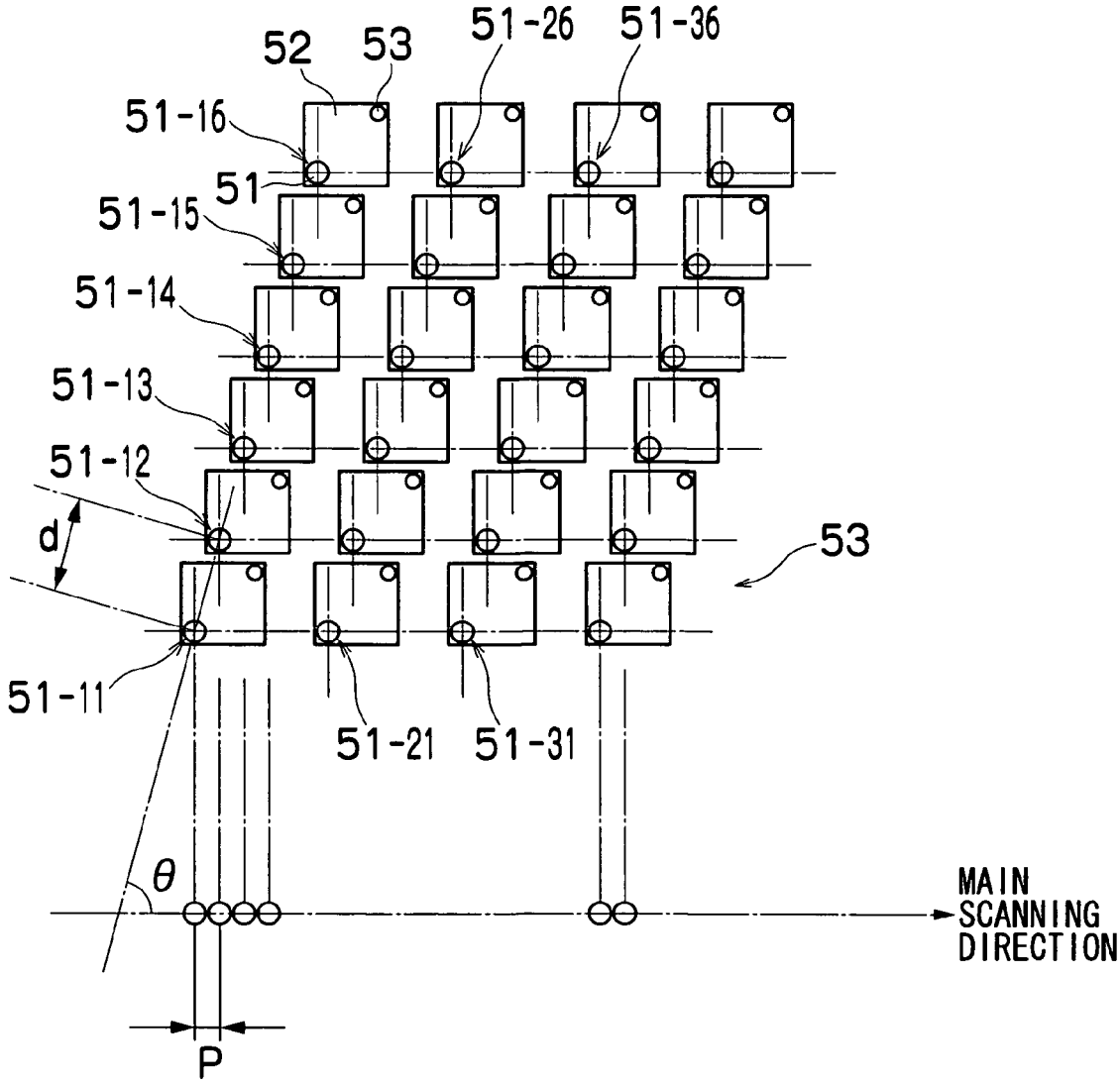
FIG. 5 is an enlarged view showing an alignment of nozzles in the print head shown in FIGS. 2A and 2B.

As shown in FIG. 5, the multiple ink chamber units 53 having this structure are aligned in a lattice with a constant alignment pattern along the column direction parallel to the main scanning direction and along the row direction that is slanted at a constant angle θ not orthogonal to the main scanning direction.

In other words, as a result of a configuration in which a plurality of the ink chamber units 53 are aligned at a constant pitch d along a certain angle θ in relation to the main scanning direction, the nozzle pitch P projected so as to be arrayed in the main scanning direction is $d \times \cos\theta$. Therefore, the main scanning direction can be treated as equivalent to the alignment of nozzles 51 in a linear pattern with a constant pitch P. Such a configuration makes it possible to achieve a high-density nozzle structure in which the nozzle array is projected so as to be in alignment with the main scanning direction.

When the nozzles are driven in a full-line head having a nozzle array which a length corresponding to the entire printable width of the medium 20, an operation such a (1) driving all of the nozzles simultaneously, (2) driving the nozzles in sequence from one side to the other side, or (3) dividing the nozzles into blocks and driving the blocks in sequence from one nozzle to the another in each block, is performed to print one line or a single strip form in the width direction of the medium 20 (which is orthogonal to the conveyance direction of the medium 20).

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the medium 20 by sequentially driving the nozzles 51-11, 51-12, . . . , 51-16 in accordance with the conveyance velocity of the medium 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

Upon implementation of the present invention, the configuration of the nozzles is not limited to the example shown in FIG. 5. Furthermore, a method of ejecting ink droplets through deformation of the actuator 58, represented by a piezo element (piezoelectric element), is employed in the present embodiment, but upon implementation of the present invention, there are no limitations on the ink ejection method. Instead of a piezoelectric method, a thermal jet method, in which bubbles are generated by heating the ink using a heat generating body such as a heater, and the ink droplets are ejected by the pressure of the bubbles, or another method may be employed.

Configuration of Ink Supply System

Figure 6:
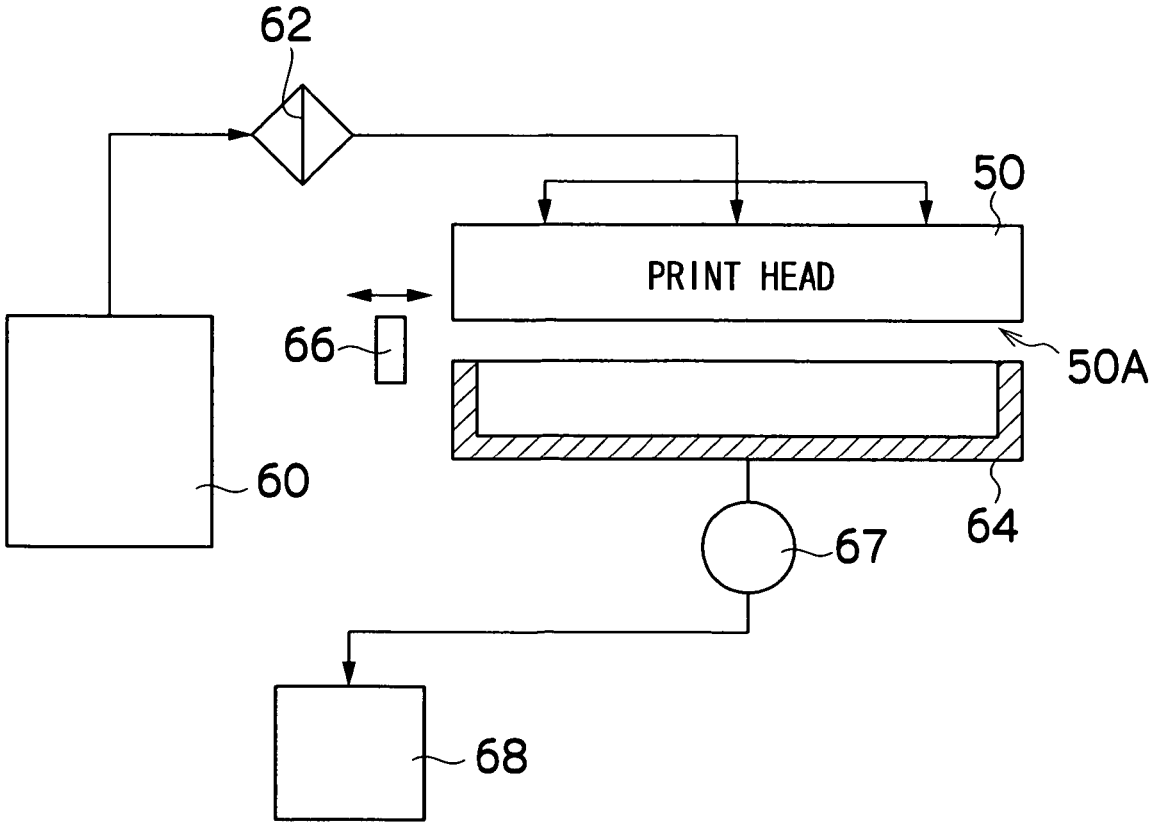
FIG. 6 is a schematic view showing configuration of an ink supply system in the inkjet recording apparatus.

FIG. 6 is a schematic view showing the configuration of the ink supply system in the inkjet recording apparatus 10. The ink tank 60 is a base tank for supplying ink to the print head 50, and is installed on the ink storing and loading unit 14 described in FIG. 1. Examples of the embodiment of the ink tank 60 include a system in which ink is refilled from a refill port (not shown) when the remaining amount of ink is low, and a cartridge system in which the tanks is replaced. The cartridge system is suitable for when the type of ink is replaced according to its intended use. In this case, it is preferable that the information of the type of ink is identified with a barcode or the like, and ejection is controlled according to the type of ink. The ink tank 60 in FIG. 6 is equivalent to the previously described ink storing and loading unit 14 shown in FIG. 1.

As shown in FIG. 6, a filter 62 is provided for removing impurities and air bubbles between the ink tank 60 and the print head 50. The filter mesh size is preferably equal to or less than the nozzle diameter. Though not shown in FIG. 6, a configuration is preferred in which a sub tank is provided either near the print head 50 or integrally with the print head 50. The sub tank has a damper effect of preventing fluctuations in the internal pressure of the head, and functions to improve refilling.

The inkjet recording apparatus 10 is also provided with a cap 64 as a device that prevents the nozzles 51 from drying or that prevents the ink near the nozzles from increasing in viscosity, and a cleaning blade 66 as a device for cleaning the nozzle surface 50A. The maintenance unit that includes the cap 64 and cleaning blade 66 is capable of moving relative to the print head 50 by means of a movement mechanism (not shown), and is moved as necessary from a specific retracted position to a maintenance position below the print head 50.

The cap 64 is displaced vertically relative to the print head 50 by a raising and lowering mechanism (not shown). When the power source is off or during print standby mode, the cap 64 is raised to a specific raised position and is sealed over the print head 50, whereby the nozzle surface 50A is covered by the cap 64.

The cleaning blade 66 is configured from an elastic member of rubber or the like, and is capable of sliding over the nozzle surface 50A of the print head 50 by means of a blade moving mechanism (not shown). When ink droplets or impurities have adhered to the nozzle surface 50A, they are removed from the nozzle plate surface by sliding the cleaning blade 66 over the nozzle surface 50A, and the nozzle surface 50A is cleaned.

During printing or standby, when the frequency of use of specific nozzles 51 is reduced and ink viscosity increases in the vicinity of the nozzles, a preliminary ejection is made to eject the degraded ink toward the cap 64.

Also, when bubbles have become intermixed in the ink inside the print head 50 (inside the pressure chamber), the cap 64 is placed on the print head 50, the ink inside the pressure chamber (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary ejection to eject the ink whose viscosity has increased in the vicinity of the nozzle toward the ink receptor. After the nozzle surface 50A is cleaned by a wiper such as the cleaning blade 66 provided as the cleaning device for the nozzle surface 50A, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

Also, when air bubbles are mixed in the nozzles 51 or the pressure chambers 52, or when the thickening of the ink in the nozzles 51 exceeds a certain level, ink cannot be ejected by the preliminary ejection described above, and therefore the suction operation described below is performed.

More specifically, when air bubbles become mixed into the ink in the nozzle 51 or pressure chamber 52, or when the viscosity of the ink inside the nozzle 51 has increased to or above a certain level, the ink can no longer be ejected from the nozzle 51 by operating the actuator 58. In such cases, the cap 64 is placed on the nozzle face of the print head 50, and a suction operation is performed to remove the ink intermixed with air bubbles or viscous ink from the pressure chamber 52 using the pump 67.

However, since this suction action is performed with respect to all the ink in the pressure chambers 52, the amount of ink consumption is considerable. Therefore, a preferred aspect is one in which a preliminary ejection is performed when the increase in the viscosity of the ink is small.

Description of Control System

Next, the control system for the inkjet recording apparatus 10 will be described.

Figure 7:
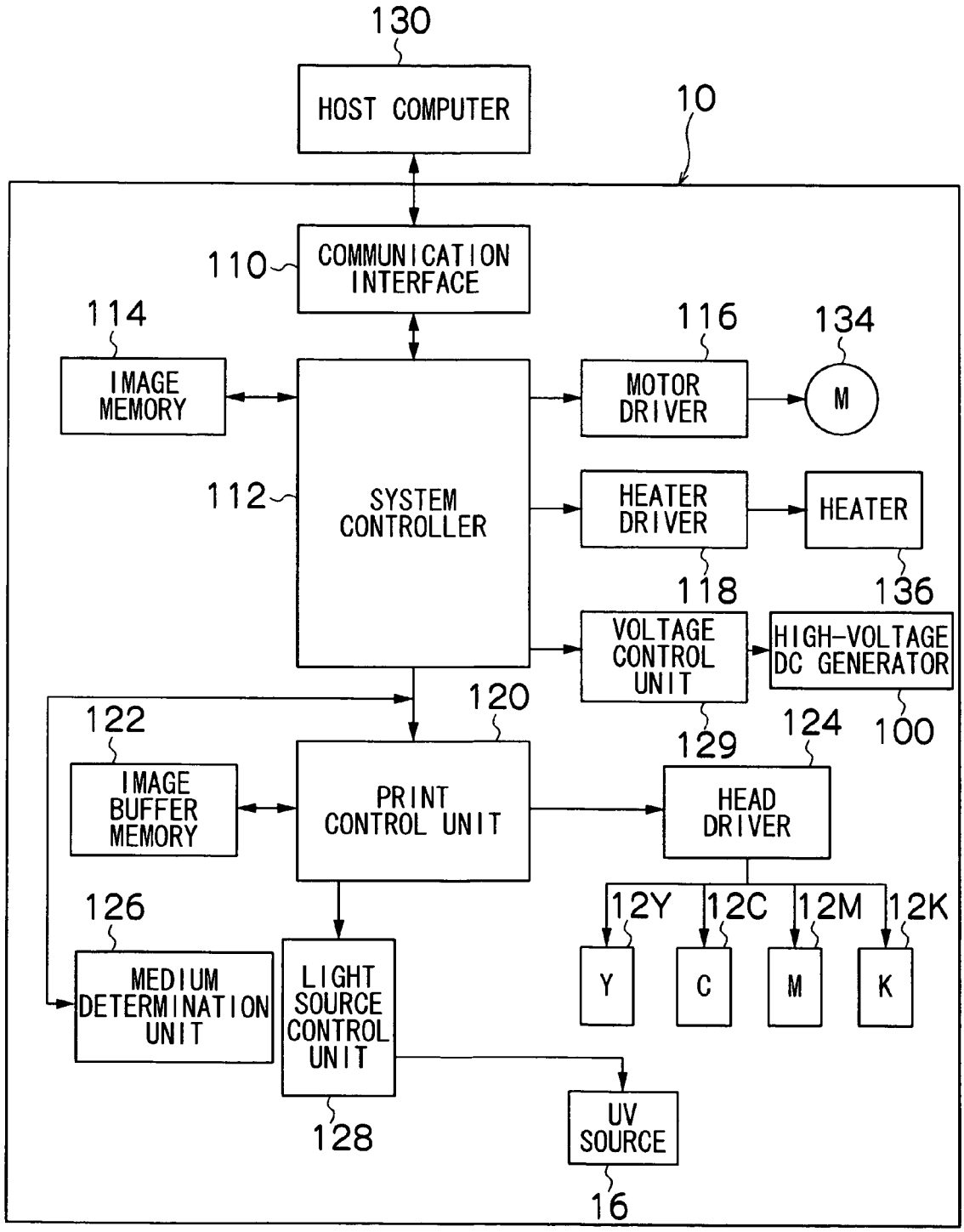
FIG. 7 is a principal block diagram showing system configuration of the inkjet recording apparatus.

FIG. 7 is a principal block diagram showing the system configuration of the inkjet recording apparatus 10. The inkjet recording apparatus 10 comprises a communication interface 110, a system controller 112, an image memory 114, a motor driver 116, a heater driver 118, a voltage control unit 129, a print control unit 120, an image buffer memory 122, a head driver 124, a medium determination unit 126, a light source control unit 128, and other components.

The communication interface 110 is an interface unit for receiving image data sent from a host computer 130. A serial interface such as USB, IEEE1394, Ethernet, wireless network, or a parallel interface such as a Centronics interface may be used as the communication interface 110. A buffer memory (not shown) may be mounted in this portion in order to increase the communication speed.

The image data sent from the host computer 130 is received by the inkjet recording apparatus 10 through the communication interface 110, and is temporarily stored in the image memory 114. The image memory 114 is a storage device for temporarily storing images inputted through the communication interface 110, and reading and writing data through the system controller 112. The image memory 114 is not limited to memory composed of a semiconductor element, and a hard disk drive or another magnetic medium may be used.

The system controller 112 is a control unit that controls the communication interface 110, the image memory 114, the motor driver 116, the heater driver 118, the voltage control unit 129, and other components. The system controller 112 is configured from a central processing unit (CPU) and its peripheral circuits and the like, controls communication between itself and the host computer 130, controls reading and writing from and to the image memory 114 and performs other functions, and also generates control signals for controlling a motor 134, the heater 136, and the high-voltage DC generator 100 in the conveyance system.

The motor driver 116 is a driver (drive circuit) that drives the motor 134 in accordance with commands from the system controller 112. The heater driver 118 is a driver that drives a heating drum 34 or another heater 136 in accordance with commands from the system controller 112.

The voltage control unit 129 controls the voltage generated by the high-voltage DC generator 100 in accordance with commands from the system controller 112.

The print control unit 120 is a control unit having a signal processing function for performing various treatment processes, corrections, and the like, in accordance with the control implemented by the system controller 112, in order to generate a signal for controlling printing from the image data in the image memory 114, and the unit supplies the print control signal (dot data) thus generated to the head driver 124. Prescribed signal processing is carried out in the print control unit 120, and the ejection amount and the ejection timing of the ink droplets from the respective print heads 12K, 12M, 12C, and 12Y are controlled via the head driver 124 according to the image data. By this means, prescribed dot sizes or dot positions can be achieved.

The print control unit 120 is provided with the image buffer memory 122; and image data, parameters, and other data are temporarily stored in the image buffer memory 122 when image data is processed in the print control unit 120. The aspect shown in FIG. 7 is one in which the image buffer memory 122 accompanies the print control unit 120; however, the image buffer memory may also serve as the image memory 114. Also possible is an aspect in which the print control unit 120 and the system controller 112 are integrated to form a single processor.

The head driver 124 drives the actuator 58 for driving ejection in the print heads 12K, 12M, 12C, and 12Y according to the dot data received from the print control unit 120. A feedback control system for keeping the drive conditions for the print heads constant may be included in the head driver 124.

The data of the image to be printed is inputted externally via the communication interface 110, and is stored in the image memory 114. In this stage, for example, RGB image data is stored in the image memory 114. The image data stored in the image memory 114 is sent to the print control unit 120 via the system controller 112, and is converted to dot data for each ink color in the print control unit 120 by a conventional dither method, an error diffusion method, or another such method.

Thus, the driving of the print heads 12K, 12M, 12C, and 12Y is controlled and ink is ejected from the print heads 12K, 12M, 12C, and 12Y according to the dot data created in the print control unit 120. An image is formed on the medium 20 by controlling the ejection of ink from the print heads 12K, 12M, 12C, and 12Y synchronously with the speed at which the medium 20 is conveyed.

The medium determination unit 126 is a device that detects the medium type or size of the medium 20. For example, either a device that reads a barcode or other such information affixed to the magazine 32 of the medium supply unit 22, or a sensor (medium width detection sensor, sensor that detects medium thickness, sensor that detects medium reflectivity, etc.) disposed at an appropriate location in the path of medium conveyance is used, or a suitable combination of these two examples is also possible. Also possible is a configuration in which medium type, size, and other such information is specified by specific inputs from the user interface instead of these automatic detection devices being used, or in addition thereto.

The information acquired by the medium determination unit 126 is sent to the system controller 112 and/or the print control unit 120, and is used to control ink ejection and the like.

The light source control unit 128 controls the turning of the UV source 16 on and off as well as the amount of light emitted when the source is on in accordance with commands from the print control unit 120.

Structure of Belt-Shaped Electrode Unit

Next, the structure of the belt-shaped electrode unit 43 will be described.

Figure 8:
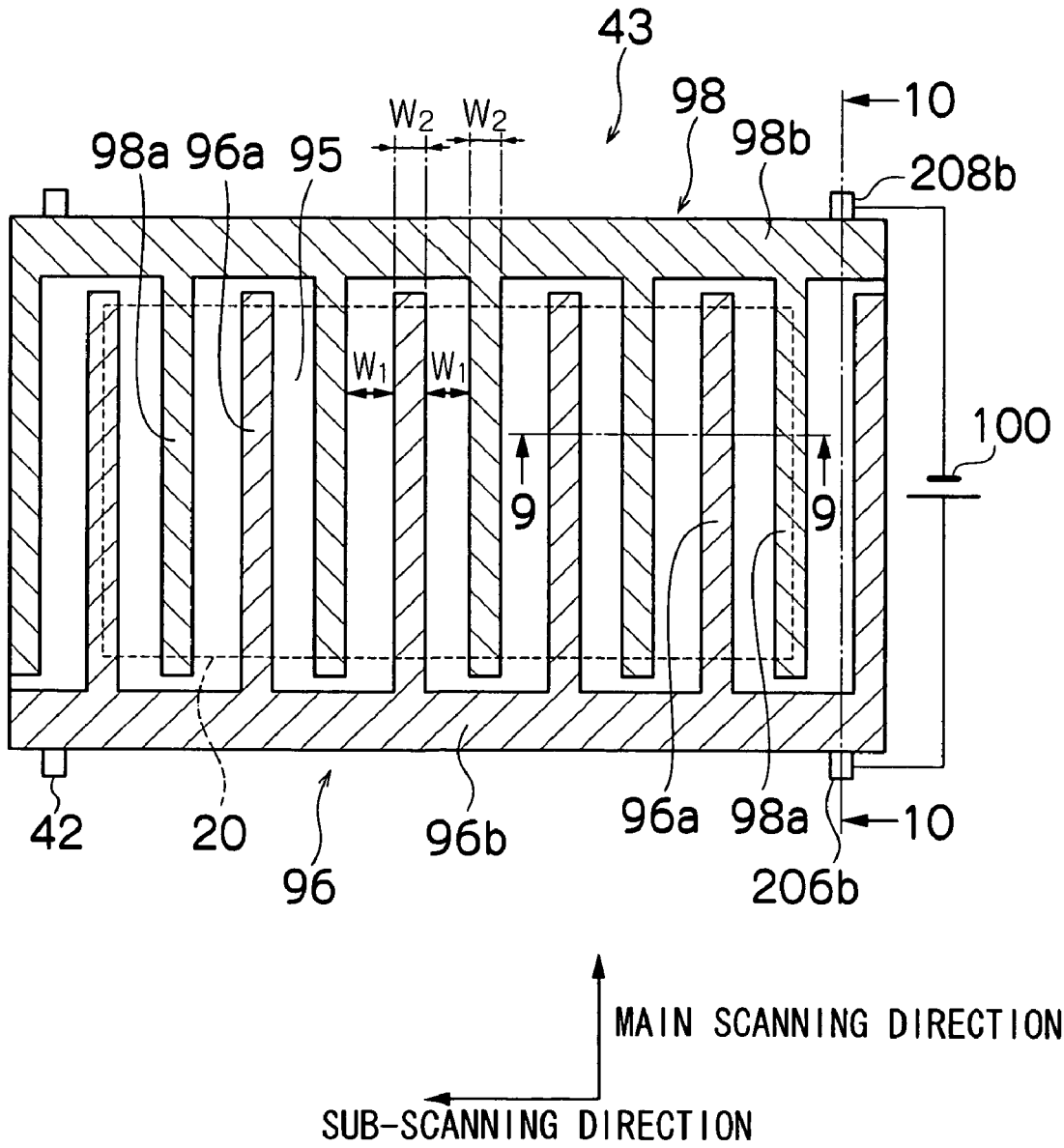
FIG. 8 is a perspective plan view showing configuration of an electrode layer of a belt-shaped electrode unit in the inkjet recording apparatus.
Figure 9:
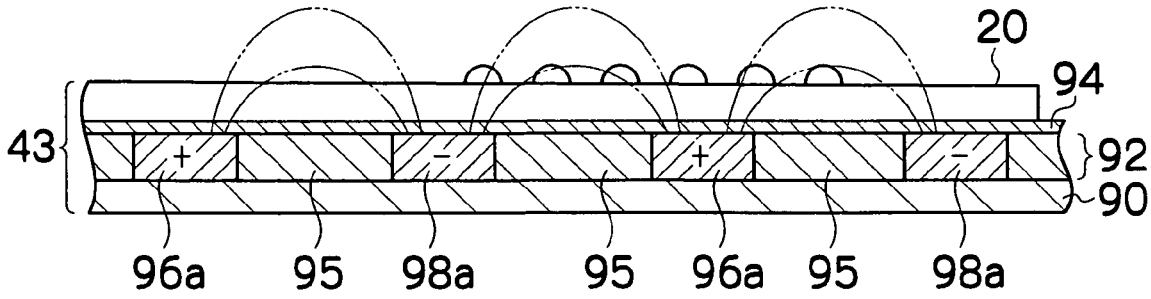
FIG. 9 is a cross-sectional view along the line 9-9 in FIG. 8.
Figure 10:
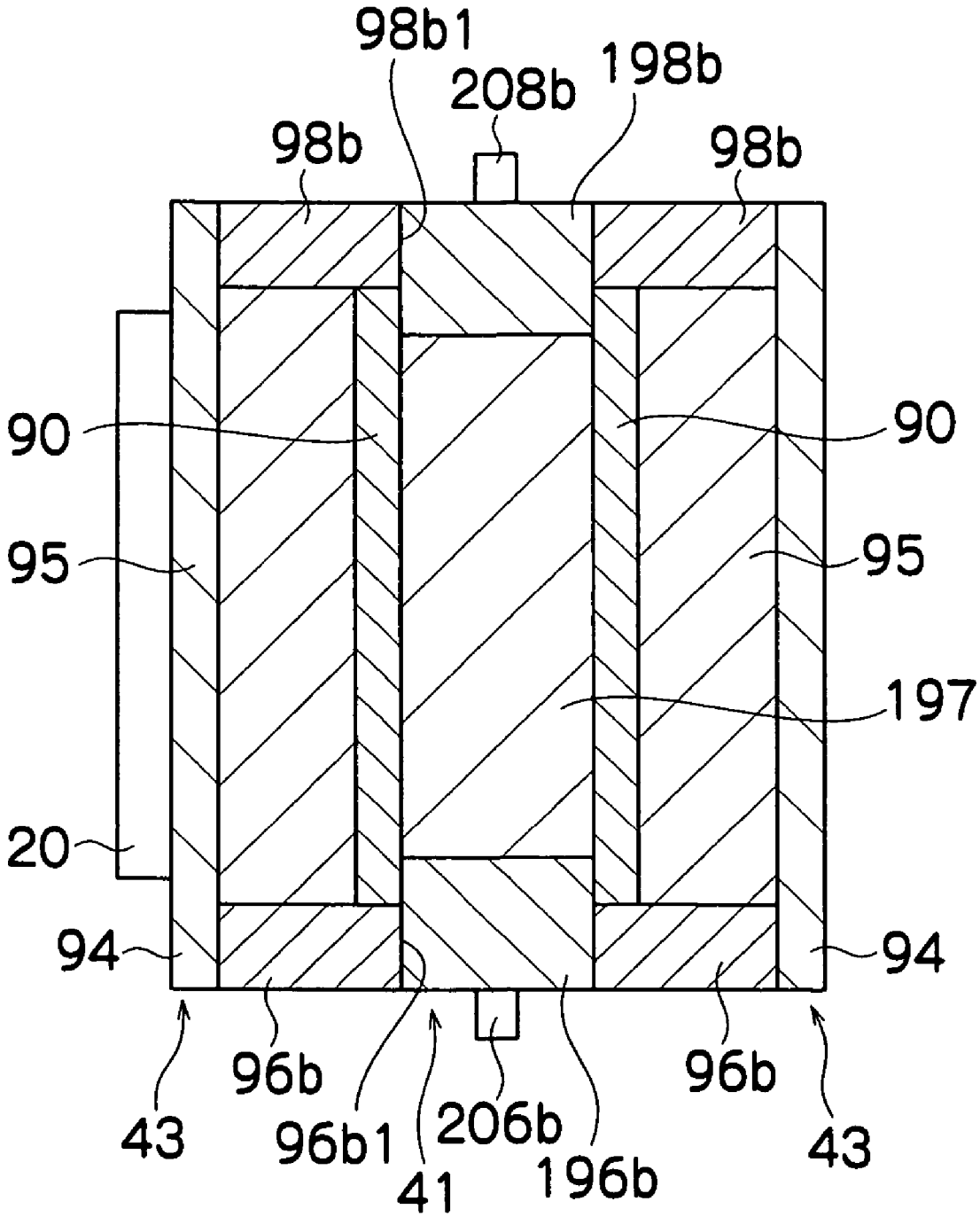
FIG. 10 is a cross-sectional view along the line 10-10 in FIG. 8.

FIG. 8 is a perspective plan view showing the configuration of the electrode layer of the belt-shaped electrode unit. FIG. 9 is a cross-sectional view along the line 9-9 in FIG. 8, and FIG. 10 is a cross-sectional view along the line 10-10 in FIG. 8. In FIGS. 8 through 10, identical reference numerals denote parts that are common to FIG. 1.

The belt-shaped electrode unit 43 is formed to be wider than the medium 20 shown by the dashed line in FIG. 8, and is configured so as to be able to reliably adhere to the medium 20. The section of the belt-shaped electrode unit 43 shown in FIG. 8, excluding the ends in the main scanning direction, is configured from three layers as shown in FIG. 9, which is configured in order of a support layer 90, an electrode layer 92, and a low-conductivity layer 94 from the lowest layer opposite the medium 20.

As shown in FIG. 8, a positive electrode 96 and a negative electrode 98 are provided with a comb shape in the electrode layer 92, and a non-conductive member 95 is provided between the positive electrode 96 and the negative electrode 98.

The positive electrode 96 comprises a plurality of comb tooth portions 96*a* which are substantially parallel to the main scanning direction, and a common electrode portion 96*b* which is formed at one end of the belt-shaped electrode unit 43 in the main scanning direction and connects the end with the comb tooth portions 96*a*. Similarly, the negative electrode 98 comprises a plurality of comb tooth portions 98*a* which are substantially parallel to the main scanning direction, and a common electrode portion 98*b* which is formed at the other end of the belt-shaped electrode unit 43 in the main scanning direction and connects this end with the comb tooth portions 98*a*.

The comb tooth portions 96*a* and 98*a* are disposed alternately in the sub-scanning direction shown in FIG. 8. The low-conductivity layer 94 is provided on the top surface of the alternately disposed comb tooth portions 96*a* and 98*a*, and the medium 20 is supported on the top surface thereof, as shown in FIG. 9.

As shown in FIG. 10, the ends of the belt-shaped electrode unit 43 in the main scanning direction are composed of a two-layer for the low-conductivity layer 94 and the common electrode portions 96*b* and 98*b*. More specifically, exposed portions 96*b*1 and 98*b*1 of the common electrode portions 96*b* and 98*b* are formed on the surface of the belt-shaped electrode unit 43 on the opposite side of the medium 20.

Also, as shown in FIG. 10, the roller 41 comprises an insulating roller 197 formed by non-conductive material, and metallic rollers 196*b* and 198*b* formed at both vertical ends of the insulating roller 197 in FIG. 10, and is axially supported by metallic shafts 206*b* and 208*b*. The insulating roller 197 is provided so as to prevent short circuits from occurring when voltage is applied to the metallic shafts 206*b* and 208*b* from the high-voltage DC generator 100 described later.

Electrical conduction is established between the metallic shaft 206*b* and metallic roller 196*b*, and between the metallic shaft 208*b* and metallic roller 198*b* respectively. Also, the exposed portions 96*b*1 and 98*b*1 of the common electrode portions 96*b* and 98*b* are configured so as to be in contact with the metallic rollers 196*b* and 198*b* of the roller 41, so that electrical conduction is established between each pair. In addition, the high-voltage DC generator 100 is connected to the metallic shafts 206*b* and 208*b* that support the roller 41, as shown in FIG. 8. Thus, electrical conduction is obtained by a simple method in the common electrode portions 96*b* and 98*b* in the present embodiment.

When a specific voltage is applied to the positive and negative electrodes 96 and 98 from the high-voltage DC generator 100, substantially arcuate lines of electric force (shown by the chain double-dashed lines in FIG. 9) are formed so as to connect the comb tooth portions 96*a* of the positive electrode 96 and the comb tooth portions 98*a* of the negative electrode 98 adjacent to the sub-scanning direction.

As shown in FIG. 9, the low-conductivity layer 94 provided to the electrode layer 92 on the side of the medium 20 is a thin layer with very low conductivity. The low-conductivity layer 94 is configured from conductive plastic or conductive rubber in which carbon or metallic powder has been kneaded into plastic or rubber, for example. When a specific voltage is applied to the positive and negative electrodes 96 and 98 from the high-voltage DC generator 100, an extremely weak electric current flows through the ink droplets deposited on the medium 20.

More specifically, when a specific voltage is applied to the positive and negative electrodes 96 and 98, an electric field is applied to the ink droplets deposited on the medium 20, and very weak electric current flows through the deposited ink droplets via the low-conductivity layer 94. Since such an operation is suitable for increasing the viscosity of deposited ink droplets having electro rheological effects, it is possible to prevent deposition interference, permeation smearing, and color smearing.

In the present embodiment, the electrical resistance rate of the low-conductivity layer 94 is preferably from $10^8$ to $10^{12}$ Ωcm. In addition, the thickness of the low-conductivity layer 94 is preferably about 0.01 mm to 1 mm.

Furthermore, since the low-conductivity layer 94 has very low conductivity as described above, it is possible to prevent the electrode layer 92 from remaining electrically charged when printing is not performed, such as when the power source is off. Also, since the surface of the electrode layer 92 on the side of the medium 20 is covered, it is possible to prevent electric shocks and other such injuries to people, while fulfilling the role of protecting the positive and negative electrodes 96 and 98.

According to the strength of the electric field applied on the medium 20, the inter-electrode distance $W_1$ (see FIG. 8) between the comb tooth portions 96*a* of the positive electrode 96 is inversely proportional to the comb tooth portions 98*a* of the negative electrode 98 disposed adjacent to the sub-scanning direction. More specifically, when the voltages applied by the high-voltage DC generator 100 are equal, the electric field strength on the medium 20 increases with a smaller inter-electrode distance $W_1$.

Consequently, the inter-electrode distance $W_1$ is preferably small, and is more preferably about 0.1 to 2 mm.

Also, the strength of the electric field applied on the medium 20 becomes more uniform with a smaller electrode width $W_2$ of the comb tooth portions 96*a* and 98*a*. Therefore, it is possible to increase the electro Theological effects on the ink droplets deposited on the medium 20. If an electrode width $W_2$ of the comb tooth portions 96*a* and 98*a* is large, the vertical components, which are oriented to the upward direction in FIG. 9, of the lines of electric force in the applied electric field, are increased. Therefore, it is impossible to obtain sufficient electro rheological effects on the ink droplets deposited on the medium 20.

Consequently, the electrode width $W_2$ is preferably small, and is more preferably about 0.01 mm to 1 mm.

Furthermore, when the strength of the electric field applied to the medium 20 is within a range of 0.1 kV/mm to 10 kV/mm, there is a large electro rheological effect on the ink droplets deposited on the medium 20. Therefore, it is preferable to control the voltage applied by the high-voltage DC generator 100 so that the strength of the electric field applied on the medium 20 is within a range of 0.1 kV/mm to 10 kV/mm.

Next, the operation of the inkjet recording apparatus 10 configured as described above will be described.

When voltage is applied to the positive and negative electrodes 96 and 98 from the high-voltage DC generator 100 via the roller 41, the medium 20 is held by suction on the belt-shaped electrode unit 43, and an electric field is applied on the medium 20.

When ink droplets are ejected from the print heads 12K, 12M, 12C, and 12Y and are deposited on the medium 20, an electric field is applied to the ink droplets while an electric current flows through the ink droplets. Since the viscosity of the ink droplets instantaneously increases by this action, it is possible to suppress permeation into the medium 20 and expansion of the dot diameter. In addition, it is also possible to suppress deposition interference between ink droplets deposited on the medium 20. Such electro rheological effects are further sustained by the electric current flowing through the deposited ink droplets via the low-conductivity layer 94. Therefore, while the medium 20 is supported or conveyed by the belt-shaped electrode unit 43, it is also possible to prevent color smearing or the like.

After the similar process for each of the colors KMCY is performed in sequence, the ink is mostly settled by passing through the UV source 16. Therefore, the ink is already sufficiently settled to an extent at which smearing or the like does not occur by the time the medium 20 is separated from the belt-shaped electrode unit 43 and the application of the electric field is removed. Accordingly it is possible to prevent deposition interference, permeation smearing, and color smearing on the medium 20, and to form high quality images.

In this manner, according to the present embodiment, since the comb tooth portions 96*a* and 98*a* of the positive and negative electrodes 96 and 98 formed in a comb shape are provided alternately on the side opposite to the printed surface of the medium 20 in the sub-scanning direction, an electric field with substantially arcuate lines of electric force between the adjacent comb tooth portions 96*a* and 98*a* is applied to the ink droplets deposited on the medium 20, and a very weak electric current flows through the deposited ink droplets via the low-conductivity layer 94. Such an operation is suitable for increasing the viscosity of deposited ink droplets which have electro rheological effects, and hence it is possible to prevent deposition interference, permeation smearing, color smearing, and the like, reliably.

In addition, since the electrode layer 92 can be disposed near the deposited ink droplets without coming in direct contact with the ink droplets deposited on the medium 20, it is possible to apply a stronger electric field on the medium 20. Furthermore, the clearance between the print heads 12K, 12M, 12C, and 12Y and the medium 20 can be kept in constant.

Method for Setting Inter-Electrode Distance

Figure 11:
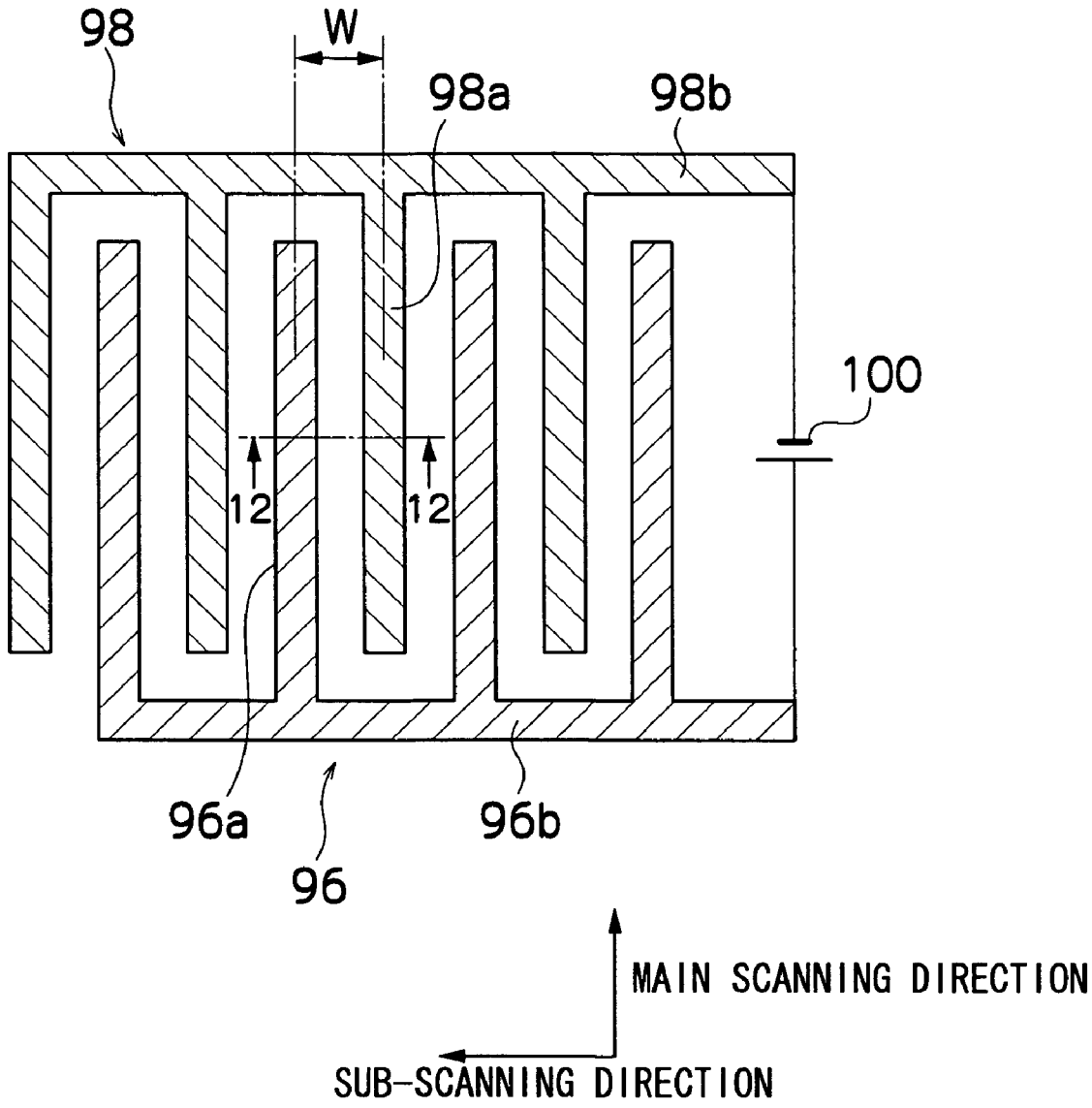
FIG. 11 is a perspective plan view showing schematic structure of the electrode layer of the belt-shaped electrode unit.
Figure 12:
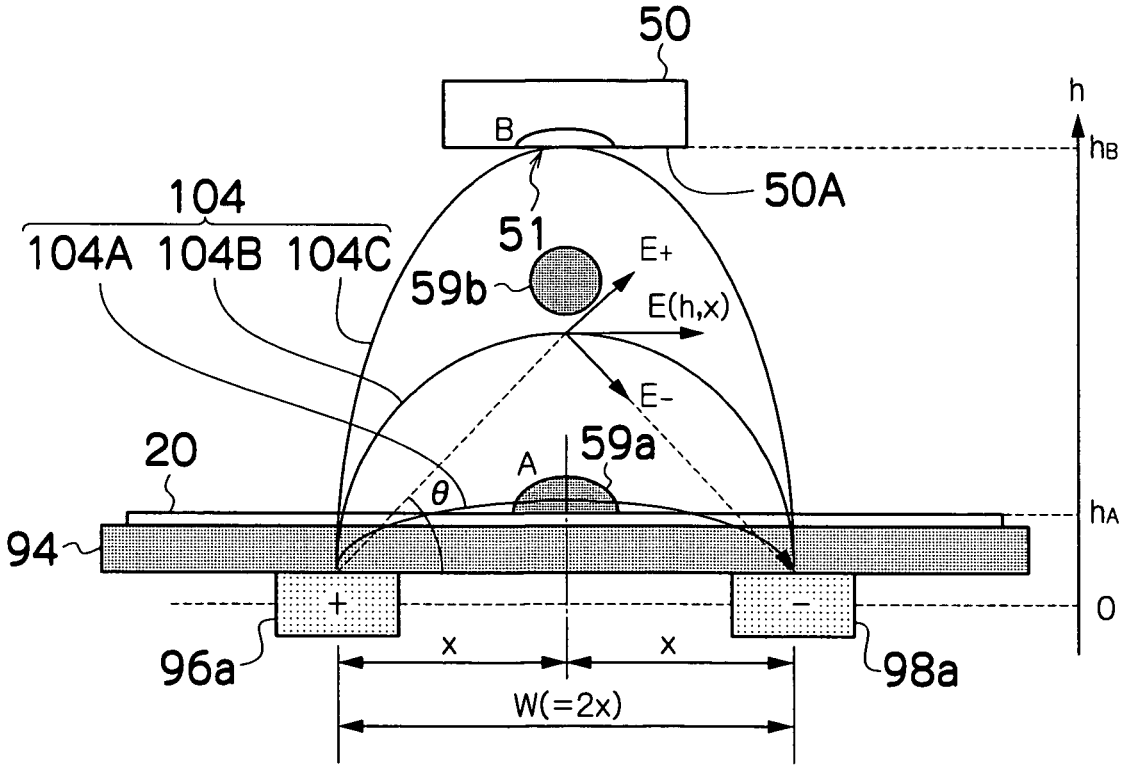
FIG. 12 is a cross-sectional view of the position 12-12 in FIG. 11, for depicting the relationship between the print head and the ink droplets on the media.

FIG. 11 is a perspective plan view showing schematic configuration of the electrode layer shown in FIG. 8. FIG. 12 is a cross-sectional view of the position 12-12 in FIG. 11, for depicting the relationship between the print head and the ink droplets on the medium 20. In FIGS. 11 and 12, identical reference numerals denote parts that are common to FIGS. 8 and 9, and description thereof is omitted here. Also, for the sake of convenience in the descriptions, the support layer 90 and the non-conductive member 95 shown in FIG. 9 are omitted in FIGS. 11 and 12. Hereinafter, the preferred method will be described relating in accordance with a setting of the inter-electrode distance W shown in FIG. 11 so as to prevent deposition interference, permeation smearing, color smearing, and the like while preventing unsatisfactory ejections resulting from ink thickening near the nozzles. Incidentally, the inter-electrode distance W in FIG. 11 is the distance of the centers of the comb tooth portions 96*a* and 98*a* in the sub-scanning direction, assuming the electrode width $W_2$ (see FIG. 8) of the comb tooth portions 96*a* and 98*a* shown in FIG. 8 is sufficiently small.

As shown in FIG. 12, the conditional parameters of electric field strength are set to the positive and negative comb tooth portions 96*a* and 98*a*, with reference to a state that the position of the ink droplets 59*a* deposited on the medium 20 is located above the substantial center of the positive and negative comb tooth portions 96*a* and 98*a*. At this time, when "x" is the distance between the ink droplets 59*a* deposited on the medium 20 and the center of the positive comb tooth portions 96*a* or the center of the negative comb tooth portions 98*a* (hereinafter referred to as the electrode distance), the inter-electrode distance W is twice of the electrode distance x.

In addition, it is denoted that "h" is the height with reference to the centers in the positive and negative comb tooth portions 96*a* and 98*a* (hereinafter referred to as electrode height), "$h_A$" is the electrode height of the ink droplets 59*a* deposited on the medium 20, and "$h_B$" is the electrode height of the nozzle surface 50A of the print head 50.

When voltage is applied to the positive and negative comb tooth portions 96*a* and 98*a*, a countless number of substantially arcuate lines of electric force 104 (104A, 104B, 104C) are formed so as to connect the positive and negative comb tooth portions 96*a* and 98*a*. At the same time, very weak electric current flows through the ink droplets 59*a* deposited on the medium 20 via the low-conductivity layer 94.

In FIG. 12, while the line of electric force 104A passes through the ink droplets 59*a* deposited on the medium 20, the line of electric force 104B passes through the bottom of the airborne ink droplets 59*b* in FIG. 12, and then the line of electric force 104C passes through the vicinity of the nozzles 51 of the print head 50.

Figure 13:
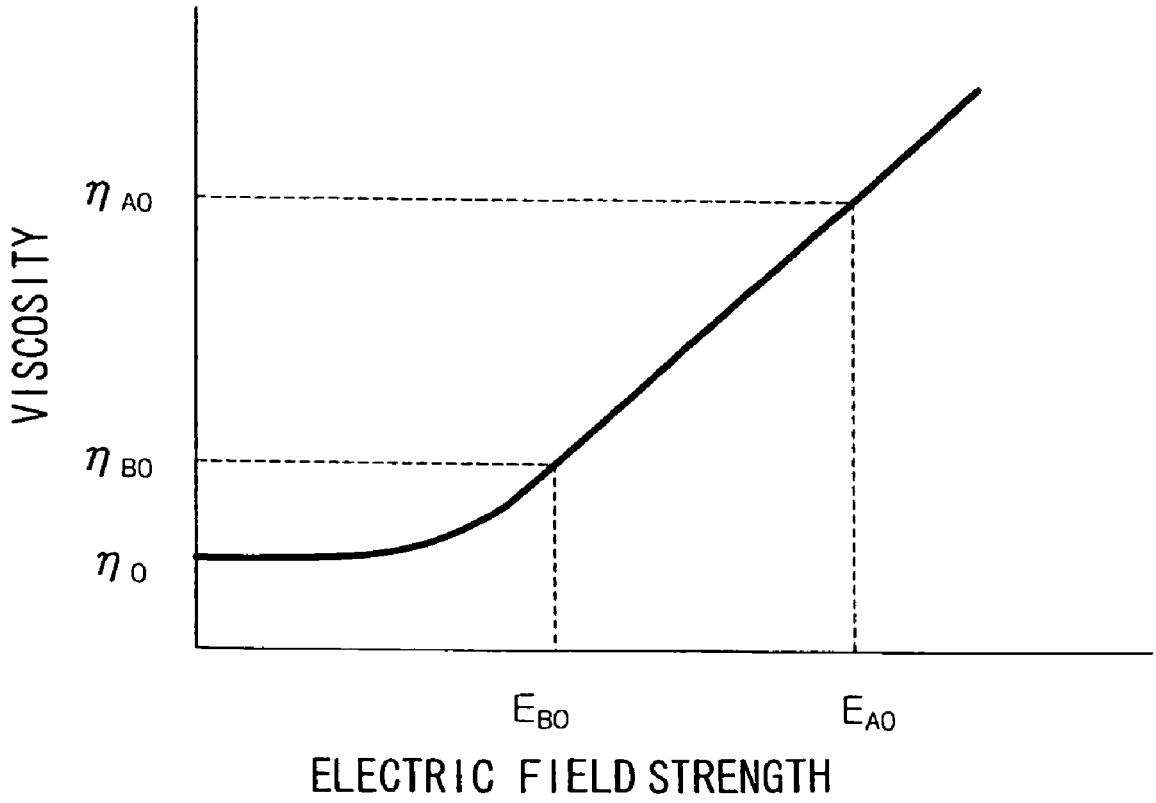
FIG. 13 is a graph showing the relationship between the strength of the electric field applied to the electro rheological fluid and the viscosity of the electro rheological fluid.

FIG. 13 is a graph showing the relationship between the strength of the electric field applied to the electro Theological fluid and the viscosity of the electro Theological fluid. As shown in FIG. 13, if the strength of the electric field applied to the electro Theological fluid with an initial viscosity $\eta_0$ increases gradually, then the viscosity of the electro rheological fluid increases. This relationship is commonly well known, as described in Japanese Patent Application Publication No. 5-4342.

When the electric field strength in the position where the ink droplets 59*a* are deposited on the medium 20 (point A in FIG. 12) is gradually increased from 0, the viscosity of the ink droplets 59*a* on the medium 20 gradually increases. When deposition interference, permeation smearing, color smearing, and the like no longer occur, the critical viscosity is denoted by "$\eta_{A0}$". In addition, the critical electric field strength at this time is denoted by "$E_{A0}$".

When the electric field strength near the nozzles 51 of the print head 50 (point B in FIG. 12) is gradually increased from 0, the viscosity of the ink near the nozzles gradually increases. When ink ejection failures, ejection position misalignments, ejection amount discrepancies, ejection time lags, and other such unsatisfactory ejections occur in the nozzles 51, the critical viscosity is denoted by "$\eta_{B0}$", and the corresponding critical electric field strength is denoted by "$E_{B0}$".

Since the critical electric field strengths $E_{A0}$ and $E_{B0}$ differ depending on the type of electro rheological fluid, and the configuration or specifics of the print head 50, it is necessary for determining the critical electric field strengths $E_{A0}$ and $E_{B0}$ through experiments or the like.

In order to prevent unsatisfactory ejections in the nozzles 51, and to prevent deposition interference, permeation smearing, color smearing, and the like on the medium 20, when the electric field strength at point A of the electrode height $h_A$ is "E ($h_A$, x)" and the electric field strength at point B of the electrode height $h_B$ is "E ($h_B$, x)", it is necessary for satisfying following inequalities (1):

$$E(h_A,x)>E_{A0} \text{ and } E(h_B,x)<E_{B0}. \quad (1)$$

More specifically, the electric field strength E ($h_A$, x) should be greater than the critical electric field strength $E_{A0}$, and the electric field strength E($h_B$, x) should be less than the critical electric field strength $E_{B0}$.

When an electric field shown in FIG. 12 is applied by the voltage applied to the positive and negative comb tooth portions 96*a* and 98*a*, the space through which the ink droplets travel, that is, the electric field strength E (h, x) at the top of the substantial center of the positive and negative comb tooth portions 96*a* and 98*a*, is a combination of the electric field strength $E_+$ from the positive comb tooth portions 96*a* and the electric field strength $E_-$ from the negative comb tooth portions 98*a*. The planar shape of the positive and negative comb tooth portions 96*a* and 98*a* is formed in a rod shape so as to extend in the main scanning direction as shown in FIGS. 8 and 11, and therefore the electric field strengths $E_+$ and $E_-$ are inversely proportionate to the distances from the positive and negative comb tooth portions 96*a* and 98*a*, respectively. Therefore, when the constant proportionate to the voltage applied to the positive and negative comb tooth portions 96*a* and 98*a* is denoted by "K", the electric field strength E (h, x) is shown as a following equation (2):

$$E(x, h) = \frac{K}{\sqrt{x^2+h^2}} \times \cos\theta \times 2 = \frac{2Kx}{x^2+h^2}. \quad (2)$$

Figure 14:
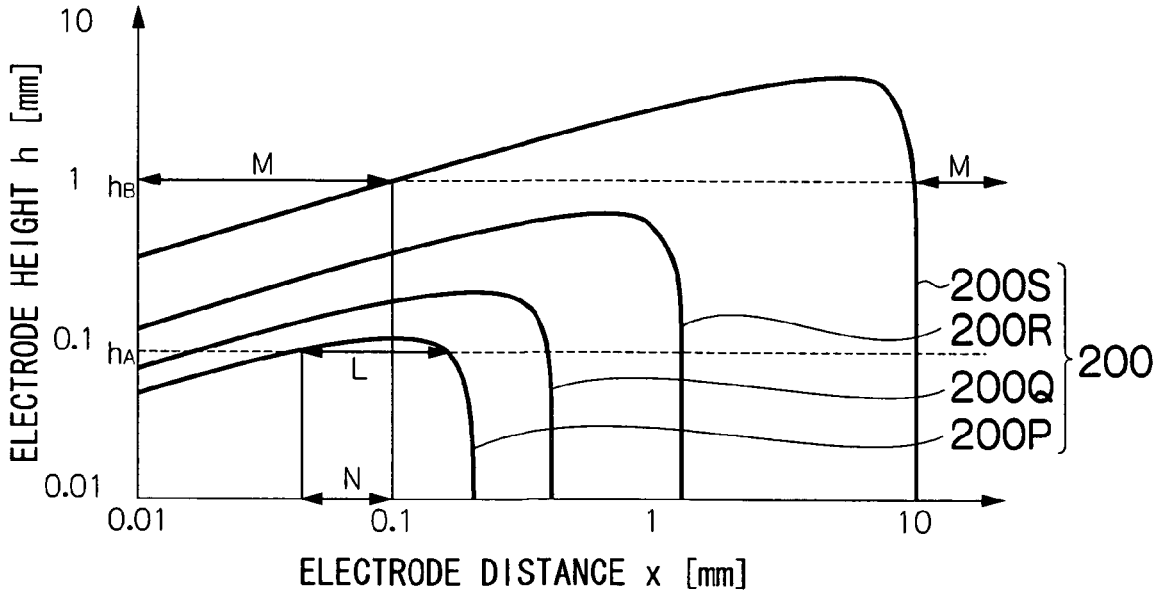
FIG. 14 is a plan view showing curves that connect groups of electrode heights and electrode distances when the electric field strength is constant.

FIG. 14 shows curves that connect groups of electrode heights h and electrode distances x at which the electric field strength E (h, x) in the equation (2) is constant. Hereinafter, the curves 200 (200P, 200Q, 200R, 200S) shown in FIG. 14 are referred to as equifield intensity curves.

In FIG. 14, the electric field strength E (h, x) delineated by the equifield intensity curve 200P is equivalent to the critical electric field strength $E_{A0}$ at point A, and the electric field strength E (h, x) delineated by the equifield intensity curve 200S is equivalent to the critical electric field strength $E_{B0}$ at point B. Also, the electric field strengths delineated by the equifield intensity curves 200Q and 200R which are positioned between the equifield intensity curve 200A and the equifield intensity curve 200B, are denoted by $E_q$ and $E_r$, respectively.

More the equifield intensity curves 200 (200P, 200Q, 200R, 200S) shift towards the upper right hand in FIG. 14, the more the electric field strengths delineated by the equifield intensity curves 200 (200P, 200Q, 200R, 200S) decrease. Therefore, it is possible to establish the relationship shown in a following inequality (3):

$$E_{A0}>E_q>E_r>E_{B0}. \quad (3)$$

The electrode height $h_A$ at point A shown in FIG. 14 is determined by the thickness of the low-conductivity layer 94 and the medium 20. According to the relationship described in the inequalities (1), the electric field strength E ($h_A$, x) in the electrode height $h_A$ is greater than the critical electric field strength $E_{A0}$ within the range of electrode distances x shown as the two-way arrow L in FIG. 14. In this case, the viscosity $\eta_A$ of the ink droplets 59*a* deposited on the medium 20 is greater than the critical viscosity $\eta_{A0}$. Therefore, it is possible to prevent deposition interference, permeation smearing, color smearing, and the like in the ink droplets 59*a* deposited on the medium 20.

Additionally, the electrode height $h_B$ at point B shown in FIG. 14 is determined by the ejection properties and the like of the print head 50. According to the relationship described in the inequalities (1), the electric field strength E ($h_B$, X) in the electrode height $h_B$ is less than the critical electric field strength $E_{B0}$ within the range of electrode distances x shown as the two-way arrow M in FIG. 14. In this case, the viscosity $\eta_B$ of the ink near the nozzles is less than the critical viscosity $\eta_{B0}$. Therefore, it is possible to prevent unsatisfactory ejections in the nozzles 51.

Accordingly, the electrode distance x which satisfies the inequalities (1) is within the range indicated by the two-way arrow N in FIG. 14, including the lower limit of the range shown as the two-way arrow L in FIG. 14 up to and including the upper limit of the range shown as the two-way arrow M in FIG. 14.

Consequently, since the inter-electrode distance W of the positive and negative comb tooth portions 96*a* and 98*a* is twice the electrode distance x determined in this manner, then it is possible to prevent unsatisfactory ejections in the nozzles 51, and to prevent deposition interference, permeation smearing, color smearing, and the like on the medium 20.

As described above, in the present embodiment, it is possible to optimize the electric field strength on the medium 20 and in the nozzle surface 50A by setting the inter-electrode distance W of the positive and negative comb tooth portions 96*a* and 98*a* without varying the distance (clearance) from the nozzle surface 50A between the print head 50 and the medium 20.

Additionally, in the equation (2), the electric field strength E (h, x) at the electrode height h and the electrode distance x is proportionate to the voltage applied to the positive and negative comb tooth portions 96*a* and 98*a*. Therefore, the electric field strength on the medium 20 and in the nozzle surface 50A can be optimized easily, by adjusting the applied voltage and setting the inter-electrode distance W of the positive and negative comb tooth portions 96*a* and 98*a*.

Second Embodiment

Next, the second embodiment of the present invention will be described.

Figure 15:
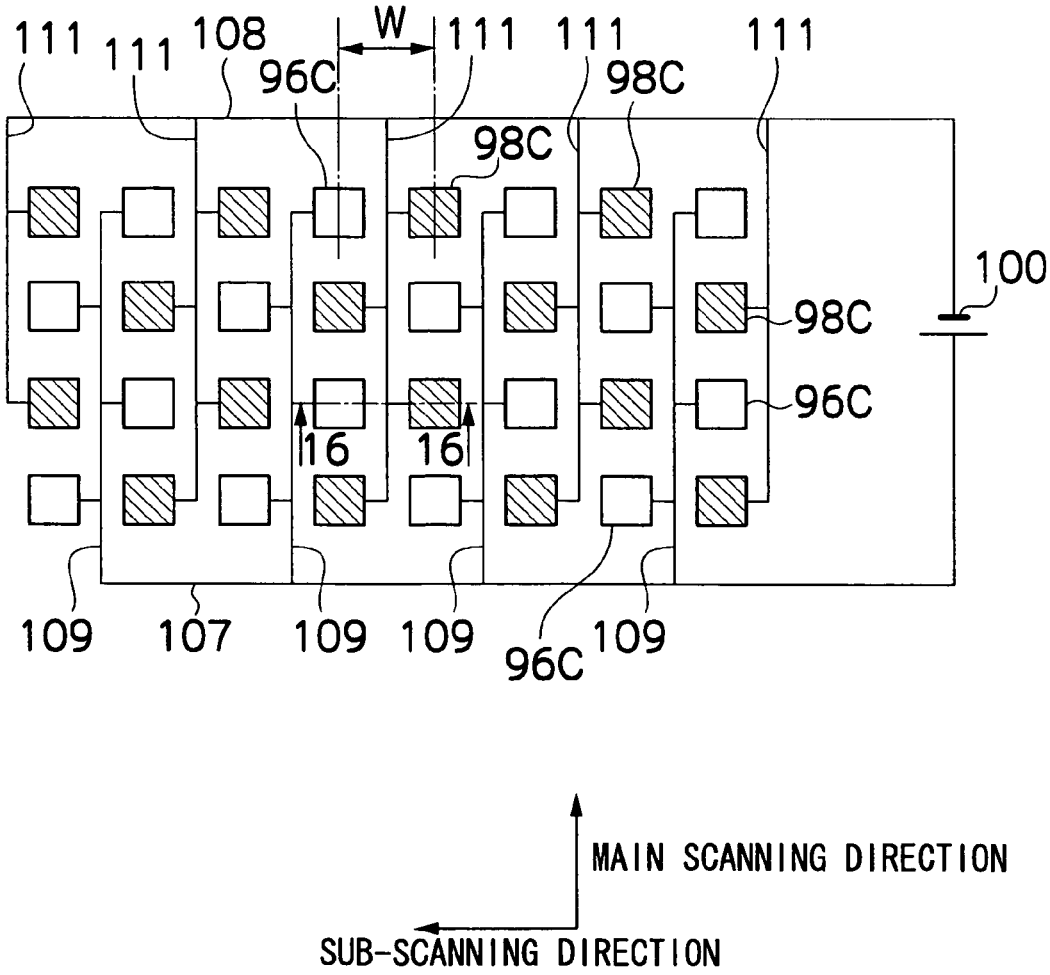
FIG. 15 is a plan view showing schematic configuration of an electrode layer according to a second embodiment of the present invention.
Figure 16:
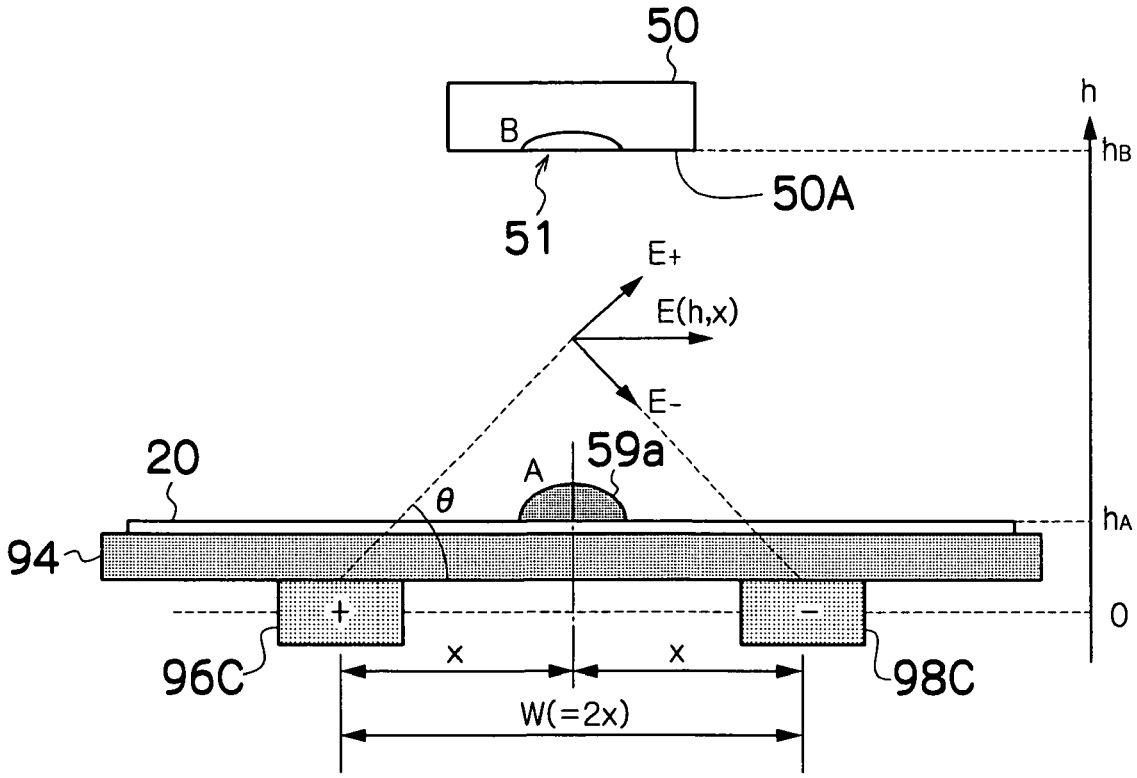
FIG. 16 is a cross-sectional view of the position 16-16 in FIG. 15, for depicting the relationship between the print head and the ink droplets on the media.

FIG. 15 is a plan view showing schematic configuration of an electrode layer according to a second embodiment of the present invention. FIG. 16 is a cross-sectional view of the position 16-16 in FIG. 15, for depicting the relationship between the print head 50 and the ink droplets on the medium 20. In FIGS. 15 and 16, identical reference numerals denote parts that are common to FIGS. 11 and 12, and description thereof is omitted here.

In the electrode layer 92 (see FIG. 9) of the present embodiment, small and substantially square electrode pieces with a positive charge (hereinafter referred to as positive electrode pieces) 96*c* and electrode pieces with a negative charge (hereinafter referred to as negative electrode pieces) 98*c* are disposed in the matrix form alternating in the main scanning direction and the sub-scanning direction, as shown in FIG. 15.

A positive common wire 107 and a negative common wire 108 connected to the high-voltage DC generator 100 are disposed at either end of the main scanning direction. Also, a positive separate wire 109 connected to the positive common wire 107, and a negative separate wire 111 connected to the negative common wire 108 are disposed within the electrode piece array in which the positive and negative electrode pieces 96*c* and 98*c* are arranged alternately in the main scanning direction.

The positive separate wire 109 is connected to each of the positive electrode pieces 96*c*, and the negative separate wire 111 is connected to each of the negative electrode pieces 98*c*.

In the second embodiment, the inter-electrode distance W of the positive and negative electrode pieces 96*c* and 98*c* are set for applying an optimum electric field so as to prevent unsatisfactory ejections in the nozzles 51 while preventing deposition interference, permeation smearing, color smearing, and the like.

As shown in FIG. 16, when the distance (electrode distance) from the ink droplets 59*a* deposited on the medium 20 to the center of the positive electrode pieces 96*c* or the center of the negative electrode pieces 98*c* is denoted as "x", the inter-electrode distance W is twice of the electrode distance x. At this time, the electrode height from the centers of the positive electrode pieces 96*c* and the negative electrode pieces 98*c* is denoted by "h", the electrode height of the surface of the medium 20 on which the ink droplets are deposited is denoted by "$h_A$", and the electrode height of the nozzle surface 50A of the print head 50 is denoted by "$h_B$".

The electric field strength E (h, x) in the ink droplets flying space above the substantial center in the positive and negative electrode pieces 96*c* and 98*c* is a combination of the electric field strength $E_+$ from the positive electrode pieces 96*c* and the electric field strength $E_-$ from the negative electrode pieces 98*c*. As shown in FIG. 15, the planar shape of the positive and negative electrode pieces 96*c* and 98*c* is a small and substantially square shape, and hence the electric field strengths $E_+$ and $E_-$ are therefore inversely proportionate to the square values of the distances from the positive and negative electrode pieces 96*c* and 98*c*, respectively. Therefore, when the constant proportionate to the voltage applied to the positive and negative electrode pieces 96*c* and 98*c* is denoted by "K", the electric field strength E (h, x) is shown as a following equation (4):

$$E(x, h) = \frac{K}{x^2 + h^2} \times \cos\theta \times 2 = \frac{2Kx}{(x^2 + h^2)^{3/2}}. \tag{4}$$

Figure 17:
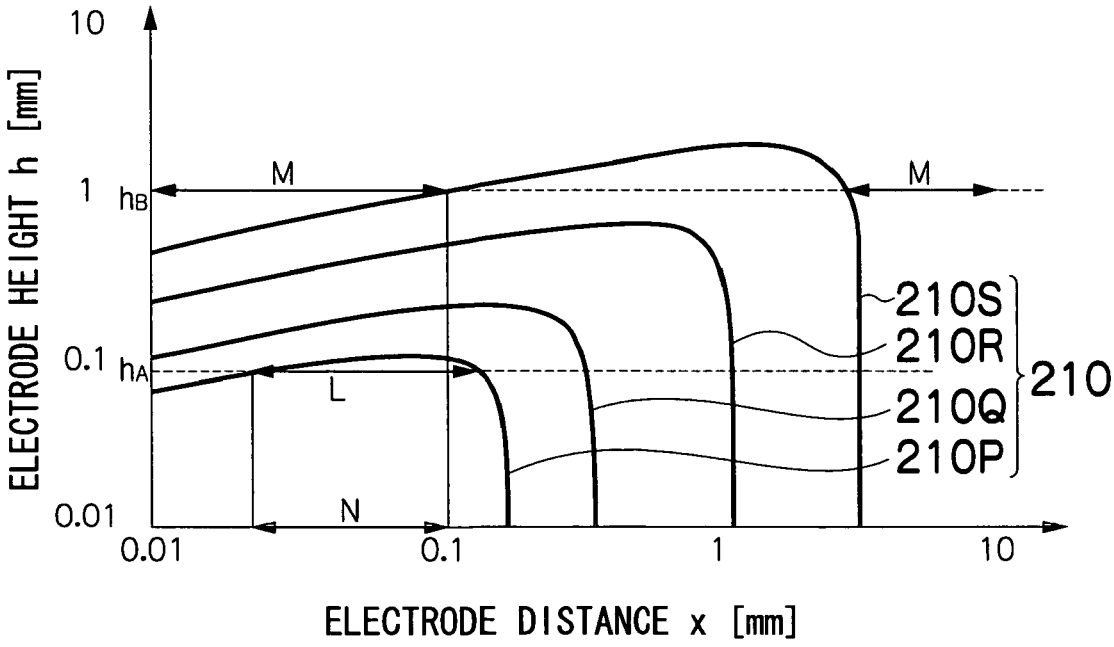
FIG. 17 is a plan view showing curves that connect groups of electrode heights and electrode distances when the electric field strength is constant.

FIG. 17 is a plan view showing curves that connect groups of electrode heights h and electrode distances x when the electric field strength E (h, x) in the equation (4) is constant. Hereinafter, the curves 210 (210P, 210Q, 210R, 210S) shown in FIG. 17 are referred to as equifield intensity curves. In FIG. 17, the equifield intensity curve 210P is equivalent to the critical electric field strength $E_{A0}$ at point A, and the equifield intensity curve 210S is equivalent to the critical electric field strength $E_{B0}$ at point B.

In the second embodiment, the electrode distance x that satisfies the inequalities (1) is determined in the same manner as in the first embodiment. More specifically, the electric field strength E ($h_A$, x) in the electrode height $h_A$ at point A shown in FIG. 16 is greater than the critical electric field strength $E_{A0}$ within the range of electrode distances x shown as the two-way arrow L in FIG. 17. In addition, the electric field strength E ($h_B$, x) in the electrode height $h_B$ at point B shown in FIG. 16 is less than the critical electric field strength $E_{B0}$ within the range of electrode distances x shown as the two-way arrow M in FIG. 17. Therefore, the electrode distance x that satisfies the inequalities (1) is within the range shown as the two-way arrow N in FIG. 17, including either ranges shown as arrows M and L previously described.

If the inter-electrode distance W of the positive electrode pieces 96*c* and the negative electrode pieces 98*c* is twice the electrode distance x determined in this manner, then it is possible to prevent unsatisfactory ejections in the nozzles 51 and to prevent deposition interference, permeation smearing, color smearing, and the like on the medium 20 without affecting the distance (clearance) between the nozzle surface 50A of the print head 50 and the medium 20.

In the same manner as in the first embodiment, it is also possible to easily optimize the electric field strength on the medium 20 and in the nozzle surface 50A by adjusting the voltage applied to the positive and negative electrode pieces 96*c* and 98*c* and setting the inter-electrode distance W.

Third Embodiment

Next, the third embodiment of the present invention will be described.

Figure 18:
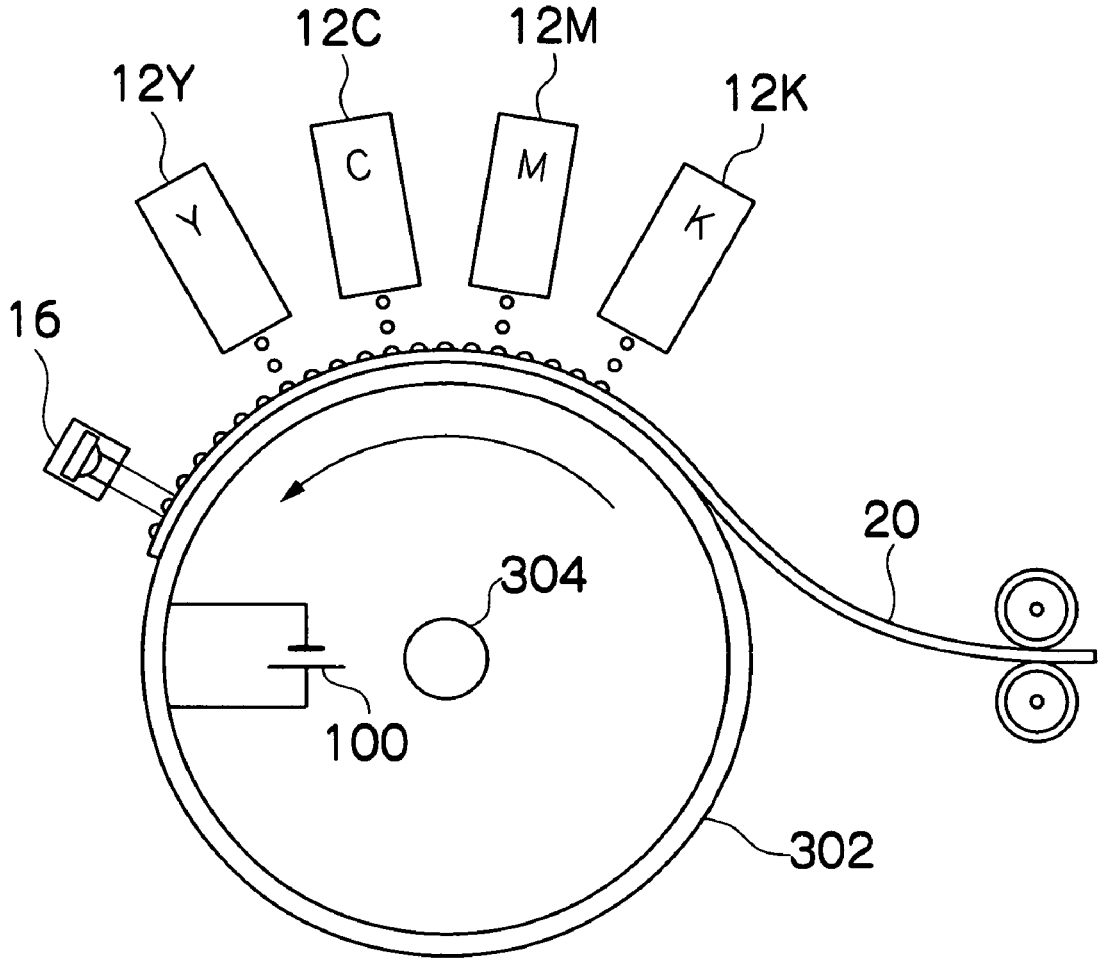
FIG. 18 is a principal schematic drawing of an inkjet recording apparatus according to a third embodiment of the present invention.

FIG. 18 is a schematic drawing showing the principal component of the inkjet recording apparatus according to the third embodiment of the present invention. In FIG. 18, identical reference numerals denote parts that are common to FIG. 1, and description thereof is omitted here.

As shown in FIG. 18, a roller-shaped electrode unit 302 is supported by a support shaft 304, and is configured to be capable of rotating around the support shaft 304 in the direction shown as an arrow in FIG. 18. The print heads 12K, 12M, 12C, and 12Y are disposed in order from upstream to downstream in the rolling direction of the roller-shaped electrode unit 302, and a UV source 16 is provided downstream of the print head 12Y.

Though not shown in FIG. 18, the roller-shaped electrode unit 302 is composed of a support layer 90, an electrode layer 92, and a low-conductivity layer 94 (see FIG. 9), similar to the belt-shaped electrode unit 43 in the first embodiment. In addition, the electrode layer 92 has positive and negative electrodes 96 and 98 formed in the comb shape, similar to the electrode layer 92 in the first embodiment. High DC voltage is applied to these electrodes by the high-voltage DC generator 100.

In the third embodiment, the electric current that flows through the deposited ink droplets and the electric field applied to the ink droplets deposited on the medium 20 is also suitable for increasing the viscosity of ink droplets with electro rheological effects, similar to the embodiments previously described. Therefore, since it is also possible to prevent unsatisfactory ejections in the nozzles 51 and to prevent deposition interference, permeation smearing, color smearing, and the like, it is possible to form satisfactory images on the medium 20.

Fourth Embodiment

Next, the fourth embodiment of the present invention will be described.

Figure 19:
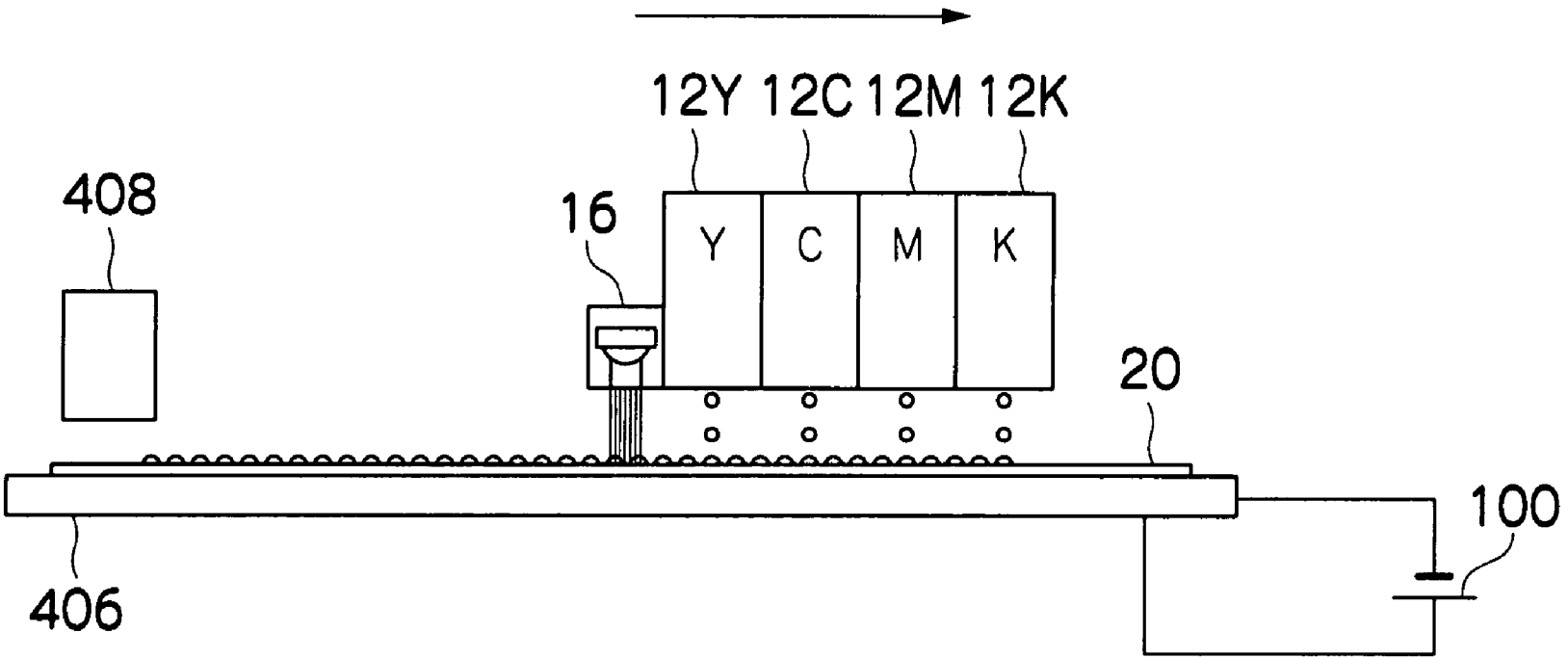
FIG. 19 is a principal schematic drawing of an inkjet recording apparatus according to a fourth embodiment of the present invention.

FIG. 19 is a principal schematic drawing of an inkjet recording apparatus according to a fourth embodiment of the present invention. In FIG. 19, identical reference numerals denote parts that are common to FIG. 1, and description thereof is omitted here.

In the fourth embodiment, ink droplets are deposited on the medium 20 to form images while the print heads 12K, 12M, 12C, and 12Y and the UV source 16 are moved in the head scanning direction shown by the arrow in FIG. 19 integrally with the medium 20 supported on a plate-shaped electrode unit 406 that is fixed in place. The medium 20 on which images are formed is suctioned by a paper suctioning unit 408, and is moved to a paper discharge unit (not shown).

Though omitted in FIG. 19, the plate-shaped electrode unit 406 is composed of the support layer 90, the electrode layer 92, and the low-conductivity layer 94, similar to the belt-shaped electrode unit 43 in the first embodiment (see FIG. 9). Also, the electrode layer 92 has the positive and negative electrodes 96 and 98 formed in the comb shape, similar to the electrode layer 92 in the first embodiment. High DC voltage is applied to these electrodes by the high-voltage DC generator 100.

In the fourth embodiment, the electric current that flows through the deposited ink droplets, and the electric field applied to the ink droplets deposited on the medium 20 is suitable for increasing the viscosity of ink droplets with electro rheological effects, similar to the embodiments previously described. Therefore, since it is also possible to prevent unsatisfactory ejections in the nozzles 51 and to prevent deposition interference, permeation smearing, color smearing, and the like, it is possible to form satisfactory images on the medium 20.

The image forming apparatus according to the present invention has been described in detail above, but the present invention is not limited to the above examples, and various improvements or modifications may of course be made within a range that does not deviate from the scope of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which ejects droplets having electro rheological effects onto a recording medium;

a holding device which holds the recording medium, the holding device being disposed at a position facing an ejection side surface of the ejection head, the recording medium interposing between the ejection head and the holding device;

a pair of electrodes which is disposed on the holding device, the pair of electrodes comprising a first electrode and a second electrode; and a voltage application device which applies a voltage to the pair of electrodes, wherein:

when a specific voltage is applied to the pair of electrodes by the voltage application device, an electric field strength having substantially arcuate lines of electric force between the pair of electrodes is applied to the droplets deposited over the entire surface of the recording medium wherein the electric filed strength on the recording medium takes a value at which the droplets deposited on the recording medium do not cause interference with each other while an electric field strength in the ejection side surface of the ejection head is not large enough to affect a droplet ejection of the ejection head, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

2. The image forming apparatus as defined in claim 1, further comprising a low-conductivity layer which is provided in a recording medium side of the pair of electrodes.

3. The image forming apparatus as defined in claim 1, wherein:

each of the first electrode and the second electrode forms in a comb shape, comprising a plurality of substantially comb tooth portions in each plane of the first electrode and the second electrode; and the comb tooth portions of the first electrode and the comb tooth portions of the second electrode are arranged alternately.

4. The image forming apparatus as defined in claim 3, wherein:

the holding device is formed with a greater width than the recording medium; and the holding device is formed so that a length of the comb tooth portions of the first electrode and the second electrode is greater than a width of the recording medium.

5. The image forming apparatus as defined in claim 3, further comprising a drive device which drives the holding device, wherein:

the holding device is an endless belt driven by the drive device;

the voltage application device applies the voltage to the drive device;

the first electrode and the second electrode are disposed so that a back part of the comb shape of the first electrode and a back part of the comb shape of the second electrode are positioned respectively at side ends of the endless belt, the back part being a common electrode portion which connects the respective comb tooth portions; and the common electrode portion comes into contact with the drive device so as to conduct electrically.

6. The image forming apparatus as defined in claim 1, wherein the holding device conveys the recording medium.

7. The image forming apparatus as defined in claim 1, wherein:

the first electrode and the second electrode are disposed at a specific distance; and the specific distance is set to a distance at which the electric field strength on the recording medium takes the value at which the droplets deposited on the recording medium do not cause interference with each other while the electric field strength in the ejection side surface of the ejection head is not large enough to affect the droplet ejection of the ejection head, when the specific voltage is applied to the pair of electrodes by the voltage application device.

8. The image forming apparatus as defined in claim 1, wherein:

each of the first electrode and the second electrode forms a comb shape, comprising a plurality of substantially comb tooth portions in each plane of the first electrode and the second electrode; and the comb tooth portions of the first electrode and the comb tooth portions of the second electrode are arranged alternately;

the comb tooth portions of the first electrode and the comb tooth portions of the second electrode are disposed at a specific distance; and the specific distance is set to a distance at which the electric field strength on the recording medium takes the value at which the droplets deposited on the recording medium do not cause interference with each other while the electric field strength in the ejection side surface of the ejection head is not large enough to affect the droplet ejection of the ejection head, when the specific voltage is applied to the pair of electrodes by the voltage application device.

9. The image forming apparatus as defined in claim 1, wherein:

each of the first electrode and the second electrode has a plurality of electrode pieces;

the electrode pieces of the first electrode and the electrode pieces of the second electrode are arranged alternately in a matrix configuration;

the electrode pieces of the first electrode and the electrode pieces of the second electrode are disposed at a specific distance; and the specific distance is set to a distance at which the electric field strength on the recording medium takes the value at which the droplets deposited on the recording medium do not cause interference with each other while the electric field strength in the ejection side surface of the ejection head is not large enough to affect the droplet ejection of the ejection head, when the specific voltage is applied to the pair of electrodes by the voltage application device.

10. An image forming apparatus, comprising:

an ejection head which ejects droplets having electro rheological effects onto a recording medium;

a holding device which holds the recording medium, the holding device being disposed at a position facing an ejection side surface of the ejection head, the recording medium interposing between the ejection head and the holding device;

a pair of electrodes which is disposed on the holding device, the pair of electrodes comprising a first electrode and a second electrode; and a voltage application device which applies a voltage to the pair of electrodes, wherein:

when a specific voltage is applied to the pair of electrodes by the voltage application device, an electric field strength having substantially arcuate lines of electric force between the pair of electrodes is applied to the droplets deposited over the entire surface of the recording medium wherein the electric filed strength on the recording medium takes a value at which a permeation speed of the deposited droplets into the recording medium is a specific value or less while an electric field strength in the ejection side surface of the ejection head is not large enough to affect a droplet ejection of the ejection head, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

11. The image forming apparatus as defined in claim 10, wherein:

the first electrode and the second electrode are disposed at a specific distance; and the specific distance is set to a distance at which the electric field strength on the recording medium takes the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

12. The image forming apparatus as defined in claim 10, wherein:

each of the first electrode and the second electrode forms a comb shape, comprising a plurality of substantially comb tooth portions in each plane of the first electrode and the second electrode; and the comb tooth portions of the first electrode and the comb tooth portions of the second electrode are arranged alternately;

the comb tooth portions of the first electrode and the comb tooth portions of the second electrode are disposed at a specific distance; and the specific distance is set to a distance at which the electric field strength on the recording medium takes the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

13. The image forming apparatus as defined in claim 10, wherein:

each of the first electrode and the second electrode has a plurality of electrode pieces;

the electrode pieces of the first electrode and the electrode pieces of the second electrode are arranged alternately in a matrix configuration;

the electrode pieces of the first electrode and the electrode pieces of the second electrode are disposed at a specific distance; and the specific distance is set to a distance at which the electric field strength on the recording medium takes the value at which the permeation speed of the deposited droplets into the recording medium is the specific value or less while the electric field strength in the ejection side surface of the ejection head is not large enough to affect the droplet ejection of the ejection head, when the specific voltage is applied to the pair of electrodes by the voltage application device.

14. The image forming apparatus as defined in claim 10, further comprising a low-conductivity layer which is provided in a recording medium side of the pair of electrodes.

15. The image forming apparatus as defined in claim 10, wherein:

each of the first electrode and the second electrode forms in a comb shape, comprising a plurality of substantially comb tooth portions in each plane of the first electrode and the second electrode; and the comb tooth portions of the first electrode and the comb tooth portions of the second electrode are arranged alternately.

16. The image forming apparatus as defined in claim 15, wherein:

the holding device is formed with a greater width than the recording medium; and the holding device is formed so that a length of the comb tooth portions of the first electrode and the second electrode is greater than a width of the recording medium.

17. The image forming apparatus as defined in claim 15, further comprising a drive device which drives the holding device, wherein:

the holding device is an endless belt driven by the drive device;

the voltage application device applies the voltage to the drive device;

the first electrode and the second electrode are disposed so that a back part of the comb shape of the first electrode and a back part of the comb shape of the second electrode are positioned respectively at side ends of the endless belt, the back part being a common electrode portion which connects the respective comb tooth portions; and the common electrode portion comes into contact with the drive device so as to conduct electrically.

18. The image forming apparatus as defined in claim 10, wherein the holding device conveys the recording medium.

19. An image forming method for an image forming apparatus, comprising the steps of:

holding a recording medium by a holding device which is disposed at a position facing an ejection side surface of an ejection head, the recording medium interposing between the ejection head and the holding device;

applying a voltage from a voltage application device to a pair of electrodes which is disposed on the holding device, the pair of electrodes comprising a first electrode and a second electrode;

ejecting droplets having electro rheological effects onto the recording medium from the ejection head; and setting a distance between the first electrode and the second electrode at a specific distance, wherein:

the specific distance is a distance at which an electric field strength having substantially arcuate lines of electric force between the first and second electrodes is applied to the droplets deposited over the entire surface of the recording medium wherein the electric filed strength on the recording medium takes a value at which the droplets deposited on the recording medium do not cause interference with each other while an electric field strength in the ejection side surface of the ejection head is not large enough to affect a droplet ejection of the ejection head, when a specific voltage is applied to the pair of electrodes by the voltage application device, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the election head with reference to the center plane of the electrodes.

20. An image forming method for an image forming apparatus, comprising the steps of:

holding a recording medium by a holding device which is disposed at a position facing an ejection side surface of an ejection head, the recording medium interposing between the ejection head and the holding device;

applying a voltage from a voltage application device to a pair of electrodes which is disposed on the holding device, the pair of electrodes comprising a first electrode and a second electrode;

ejecting droplets having electro rheological effects onto the recording medium from the ejection head; and setting a distance between the first electrode and the second electrode at a specific distance, wherein:

the specific distance is a distance at which an electric field strength having substantially arcuate lines of electric force between the pair of electrodes is applied to the droplets deposited over the entire surface of the recording medium wherein the electric filed strength on the recording medium takes a value at which a permeation speed of the deposited droplets into the recording medium is a specific value or less while an electric field strength in the ejection side surface of the ejection head is not large enough to affect a droplet ejection of the ejection head, when a specific voltage is applied to the pair of electrodes by the voltage application device, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

21. An image forming apparatus, comprising:

an ejection head which ejects droplets having electro rheological effects onto a recording medium;

a holding device which holds the recording medium, the holding device being disposed at a position facing an ejection side surface of the ejection head, the recording medium interposing between the ejection head and the holding device;

a pair of electrodes which is disposed on the holding device, the pair of electrodes comprising a first electrode and a second electrode; and a voltage application device which applies a voltage to the pair of electrodes, wherein:

when a specific voltage is applied to the pair of electrodes by the voltage application device, an electric field strength on the recording medium takes a value at which the droplets deposited on the recording medium do not cause interference with each other while an electric field strength in the ejection side surface of the ejection head is not large enough to affect a droplet ejection of the ejection head, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

22. An image forming apparatus, comprising:

an ejection head which ejects droplets having electro rheological effects onto a recording medium;

a holding device which holds the recording medium, the holding device being disposed at a position facing an ejection side surface of the ejection head, the recording medium interposing between the ejection head and the holding device;

a pair of electrodes which is disposed on the holding device, the pair of electrodes comprising a first electrode and a second electrode; and a voltage application device which applies a voltage to the pair of electrodes, wherein:

when a specific voltage is applied to the pair of electrodes by the voltage application device, an electric field strength on the recording medium takes a value at which a permeation speed of the deposited droplets into the recording medium is a specific value or less while an electric field strength in the ejection side surface of the ejection head is not large enough to affect a droplet ejection of the ejection head, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

23. An image forming method for an image forming apparatus, comprising the steps of:

holding a recording medium by a holding device which is disposed at a position facing an ejection side surface of an ejection head, the recording medium interposing between the ejection head and the holding device;

applying a voltage from a voltage application device to a pair of electrodes which is disposed on the holding device, the pair of electrodes comprising a first electrode and a second electrode;

ejecting droplets having electro rheological effects onto the recording medium from the ejection head; and setting a distance between the first electrode and the second electrode at a specific distance, wherein:

the specific distance is a distance at which an electric field strength on the recording medium takes a value at which the droplets deposited on the recording medium do not cause interference with each other while an electric field strength in the ejection side surface of the ejection head is not large enough to affect a droplet ejection of the ejection head, when a specific voltage is applied to the pair of electrodes by the voltage application device, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

24. An image forming method for an image forming apparatus, comprising the steps of:

holding a recording medium by a holding device which is disposed at a position facing an ejection side surface of an ejection head, the recording medium interposing between the ejection head and the holding device;

applying a voltage from a voltage application device to a pair of electrodes which is disposed on the holding device, the pair of electrodes comprising a first electrode and a second electrode;

ejecting droplets having electro rheological effects onto the recording medium from the ejection head; and setting a distance between the first electrode and the second electrode at a specific distance, wherein:

the specific distance is a distance at which an electric field strength on the recording medium takes a value at which a permeation speed of the deposited droplets into the recording medium is a specific value or less while an electric field strength in the ejection side surface of the ejection head is not large enough to affect a droplet ejection of the ejection head, when a specific voltage is applied to the pair of electrodes by the voltage application device, wherein the electric field strength is a function of the voltage and an arrangement of said pair of electrodes including disposing said first electrode and said second electrode at a specific distance, the electric field strength being configured such that the electric field strength in the ejection side surface of the ejection head is not large enough to affect droplet ejection of the ejection head, and wherein the specific distance is a range determined according to the equation:

$$\frac{K-\sqrt{K^2-E_{A0}^2h_A^2}}{E_{A0}} < x < \frac{K-\sqrt{K^2-E_{B0}^2h_B^2}}{E_{B0}},$$

where x represents half the specific distance, K represents a constant proportionate to the voltage applied to the first and second electrodes, $E_{A0}$ represents a first electric field strength threshold above which droplets deposited on the recording medium do not cause interference with each other, $E_{B0}$ represents a second electric field strength threshold below which droplet ejection of the ejection head is not affected by the electric field strength, $h_A$ represents a height of the droplets deposited on the recording medium with reference to a center plane of the electrodes, and $h_B$ represents a height of the ejection side surface of the ejection head with reference to the center plane of the electrodes.

* * * * *